US010845837B2

(12) United States Patent
Bae et al.

(10) Patent No.: US 10,845,837 B2
(45) Date of Patent: Nov. 24, 2020

(54) SEMICONDUCTOR DEVICE INCLUDING NON-VOLATILE MEMORY, A BIAS CURRENT GENERATOR AND AN ON-CHIP TERMINATION RESISTOR, METHOD OF FABRICATING THE SAME AND METHOD OF OPERATING THE SAME

(71) Applicant: Samsung Electronics Co., Ltd., Suwon-si (KR)

(72) Inventors: Junhan Bae, Hwaseong-si (KR); Chang-Kyung Seong, Yongin-si (KR); Jongshin Shin, Yongin-si (KR)

(73) Assignee: SAMSUNG ELECTRONICS CO., LTD.

( * ) Notice: Subject to any disclaimer, the term of this patent is extended or adjusted under 35 U.S.C. 154(b) by 0 days.

(21) Appl. No.: 16/273,104

(22) Filed: Feb. 11, 2019

(65) Prior Publication Data

US 2019/0346872 A1 Nov. 14, 2019

(30) Foreign Application Priority Data

May 8, 2018 (KR) ..... 10-2018-0052460

(51) Int. Cl.
*G05F 3/16* (2006.01)

(52) U.S. Cl.
CPC ..... *G05F 3/16* (2013.01)

(58) Field of Classification Search
CPC ..... G11C 7/062; G11C 5/147; G11C 16/28; G11C 13/004; G05F 3/16; G05F 1/575
See application file for complete search history.

(56) References Cited

U.S. PATENT DOCUMENTS

| | | | | |
|---|---|---|---|---|
| 6,980,020 | B2 | 12/2005 | Best et al. | |
| 7,454,305 | B2 | 11/2008 | Bonaccio et al. | |
| 8,482,293 | B2 | 7/2013 | Tyan et al. | |
| 9,000,800 | B1 | 4/2015 | Cical et al. | |
| 9,660,647 | B2 | 5/2017 | Chern et al. | |
| 2004/0239545 | A1* | 12/2004 | Tsai | H03M 1/0626 341/155 |
| 2005/0134303 | A1 | 6/2005 | Best et al. | |
| 2005/0154964 | A1* | 7/2005 | Vityaev | G11B 20/1833 714/769 |
| 2007/0115019 | A1 | 5/2007 | Bonaccio et al. | |
| 2008/0246537 | A1* | 10/2008 | Aziz | G05F 1/56 327/540 |
| 2011/0074520 | A1 | 3/2011 | Tyan et al. | |

(Continued)

FOREIGN PATENT DOCUMENTS

| | | | |
|---|---|---|---|
| CN | 105071785 | A | 11/2015 |
| CN | 105094205 | A | 11/2015 |

(Continued)

*Primary Examiner* — Sibin Chen
(74) *Attorney, Agent, or Firm* — Renaissance IP Law Group LLP

(57) ABSTRACT

A semiconductor device includes a voltage generator generating a reference voltage, a first reference current generator receiving the reference voltage and generating a reference current, a non-volatile memory storing a calibration code, a first bias current generator mirroring the reference current to generate a first bias current, and a second bias current generator adjusting the reference current according to the calibration code of the non-volatile memory to generate a second bias current.

23 Claims, 22 Drawing Sheets

(56) References Cited

U.S. PATENT DOCUMENTS

| | | | | |
|---|---|---|---|---|
| 2014/0037097 | A1* | 2/2014 | LaBosco | H04R 29/001 381/59 |
| 2015/0349793 | A1* | 12/2015 | Saripalli | H03M 1/1019 341/120 |
| 2016/0118984 | A1 | 4/2016 | Chern et al. | |

FOREIGN PATENT DOCUMENTS

| | | | |
|---|---|---|---|
| CN | 105575837 | A | 5/2016 |
| CN | 105094205 | B | 8/2017 |

* cited by examiner

SEMICONDUCTOR DEVICE INCLUDING NON-VOLATILE MEMORY, A BIAS CURRENT GENERATOR AND AN ON-CHIP TERMINATION RESISTOR, METHOD OF FABRICATING THE SAME AND METHOD OF OPERATING THE SAME

CROSS-REFERENCE TO RELATED APPLICATION

This application claims priority under 35 U.S.C. § 119 to Korean Patent Application No. 10-2018-0052460, filed on May 8, 2018, in the Korean Intellectual Property Office (KIPO), the disclosure of which is incorporated by reference in its entirety.

TECHNICAL FIELD

The present inventive concept relates to a semiconductor device including a non-volatile memory, a bias current generator and an on-chip termination resistor, a method of fabricating the same and a method of operating the same.

DISCUSSION OF RELATED ART

An electronic device, in particular, a semiconductor device is fabricated to include various semiconductor elements. For example, various elements of an integrated circuit, such as a resistor, a capacitor, and a transistor, are fabricated by using semiconductor (or semiconductor materials). Operating characteristics of the semiconductor elements may vary with various environment factors such as a temperature, moisture, and a location on a wafer.

That is, resistance values of the resistors, capacitances of the capacitors, and the amounts of currents of the transistors may vary with process variations associated with a fabricating process.

Various currents or voltages are used in the semiconductor device. Specific components in the semiconductor device may need relative currents or voltages. For example, the same process variations are applied to semiconductor elements in the semiconductor device. Accordingly, the process variations may be offset in specific components, and the specific components may need relative currents or voltages, which do not accompany calibration.

Any other components in the semiconductor device may need absolute currents or voltages. For example, the process variations may not be offset in the other components of the semiconductor device. In this case, operating characteristics of the other components may vary with the process variations. Accordingly, the other components may need currents or voltages calibrated to compensate for the process variations, that is, the absolute currents or voltages.

As such, elements for generating relative currents or voltages and elements for generating absolute currents or voltages are necessary in the semiconductor device. In particular, there is a demand on semiconductor devices which include current or voltage generation elements with reduced complexity, and thus, reduced fabricating costs.

SUMMARY

Embodiments of the inventive concept provide an integrated circuit of generating a current or a voltage with reduced complexity, and thus, reduced fabricating costs, and a method of generating a current of the integrated circuit.

According to an exemplary embodiment of the present inventive concept, a semiconductor device includes a voltage generator generating a reference voltage, a first reference current generator receiving the reference voltage and generating a reference current, a non-volatile memory storing a calibration code, a first bias current generator mirroring the reference current to generate a first bias current, and a second bias current generator adjusting the reference current according to the calibration code of the non-volatile memory to generate a second bias current.

According to an exemplary embodiment of the present inventive concept, a semiconductor device includes a non-volatile memory storing a calibration code, a voltage generator generating a reference voltage, a second reference current generator receiving the reference voltage and generating a second reference current according to the calibration code of the non-volatile memory, and a second bias current generator mirroring the second reference current to generate a second bias current.

According to an exemplary embodiment of the present inventive concept, a method of fabricating a semiconductor device including a non-volatile memory, a bias current generator and an on-chip termination resistor is provided as follows. A calibration code representing a deviation of a device parameter from a designed value is generated by calibrating the bias current generator using the calibration code. The calibration code is stored in the non-volatile memory.

According to an exemplary embodiment of the present inventive concept, a method of operating a semiconductor device having a non-volatile memory programmed with a calibration code, a bias current generator and an on-chip termination resistor is provided as follows. The calibration code is read from the non-volatile memory. The calibration code represents a degree of deviation of a device parameter from a designed value. The bias current generator is set using the calibration code to have a driving capability according to the calibration code.

BRIEF DESCRIPTION OF THE DRAWINGS

The above and other objects and features of the inventive concept will become apparent by describing in detail exemplary embodiments thereof with reference to the accompanying drawings.

DETAILED DESCRIPTION OF EXEMPLARY EMBODIMENTS

Below, embodiments of the inventive concept may be described in detail and clearly to such an extent that an ordinary one in the art easily implements the inventive concept.

Figure 1:
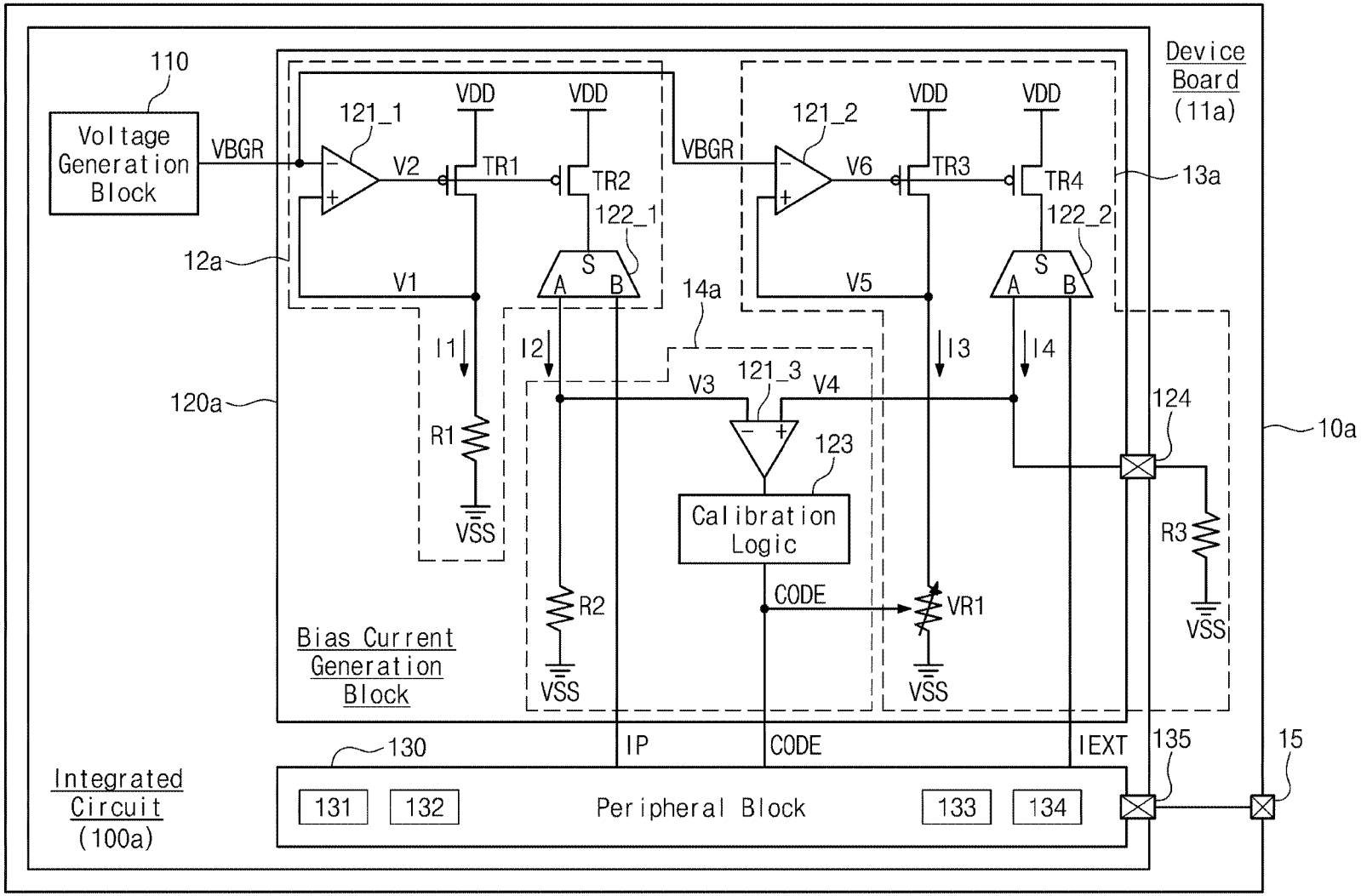
FIG. 1 is a diagram illustrating a semiconductor device including an integrated circuit according to a first embodiment of the inventive concept.

FIG. 1 is a diagram illustrating a semiconductor device 10*a* including an integrated circuit 100*a* according to an exemplary embodiment of the inventive concept. Referring to FIG. 1, the semiconductor device 10*a* includes a device board 11*a*. The device board 11*a* may be a printed circuit board. The integrated circuit 100*a* and a third resistor R3 may be positioned on the device board 11*a*.

The third resistor R3 may be connected between a first connection pad 124 of the integrated circuit 100*a* and a ground node to which a ground voltage VSS is connected. For example, the device board 11*a* may be a package board. The integrated circuit 100*a* and the third resistor R3 may be attached on the device board 11*a* and may be packaged.

The integrated circuit 100*a* includes a voltage generation block 110, a bias current generation block 120*a*, and a peripheral block 130. The voltage generation block 110 may provide a reference voltage VBGR to the bias current generation block 120*a*. For example, the reference voltage VBGR may represent a bandgap voltage which is uniform regardless of the influence of environment. In an exemplary embodiment, the voltage generation block 110 may include the voltage generator generating a reference voltage VBGR.

The bias current generation block 120*a* may generate a first bias current IP and a second bias current IEXT by using the reference voltage VBGR. The first bias current IP may include a relative current having a characteristic (e.g., a current amount) which varies with a process variation. The second bias current IEXT may include an absolute current having a characteristic (e.g., a current amount) which is uniform regardless of the process variation.

The bias current generation block 120*a* may include first to third amplifiers 121_1 to 121_3, first and second multiplexers 122_1 and 122_2, a calibration logic 123, first and second resistors R1 and R2, a first variable resistor VR1, and first to fourth transistors TR1 to TR4.

The first amplifier 121_1, the first multiplexer 122_1, the first resistor R1, and the first and second transistors TR1 and TR2 of the bias current generation block 120*a* in the integrated circuit 100*a* may constitute a first current generation unit 12*a* which generates the first bias current IP.

The reference voltage VBGR is transmitted to a negative input of the first amplifier 121_1. A positive input of the first amplifier 121_1 is connected to a node between the first transistor TR1 and the first resistor R1. The first resistor R1 is connected between the first transistor TR1 and the ground node. The first transistor TR1 is connected between a power node supplied with a power supply voltage VDD and the first resistor R1.

The first amplifier 121_1 may amplify a difference between the reference voltage VBGR and a first voltage V1 of the node between the first transistor TR1 and the first resistor R1 and may output a second voltage V2. The second voltage V2 is transmitted to a gate of the first transistor TR1. The first amplifier 121_1, the first resistor R1, and the first transistor TR1 may constitute a feedback loop for uniformly maintaining the first voltage V1 at the same level as the reference voltage VBGR and adjusting the amount of a first current I1 flowing through the first resistor R1 and the first transistor TR1 to a value obtained by dividing the reference voltage VBGR by a resistance value of the first resistor R1.

The second transistor TR2 is connected between the power node and the first multiplexer 122_1. The second voltage V2 is transmitted to a gate of the second transistor TR2. The second transistor TR2 may mirror and output the first current I1.

In a first operating mode (e.g., a calibration mode), the first multiplexer 122_1 may connect a first node "S" with a second node "A". The second transistor TR2 may supply the mirrored current as a second current I2 to the second resistor R2. A third voltage V3 across the resistor R2 may be supplied to a calibration unit 14*a*.

In a second operating mode (e.g., a normal operating mode), the first multiplexer 122_1 may connect the first node "S" with a third node "B". The second transistor TR2 may supply the mirrored current as the first bias current IP to the peripheral block 130. The first node "S" may be referred to as an output of the first multiplexer 122_1. The second node "A" may be referred to as a first input of the first multiplexer 122_1, and the third node "B" may be referred to as a third input of the first multiplexer 122_1.

These descriptions may apply to another multiplexer described below otherwise described.

The second amplifier 121_2, the second multiplexer 122_2, and the first variable resistor VR1 of the bias current generation block 120*a* in the integrated circuit 100*a*, the first connection pad 124 electrically connecting the bias current generation block 120*a* and the device board 11*a* (e.g., the third resistor R3), and the third resistor R3 positioned at the device board 11*a* outside the integrated circuit 100*a* may constitute a second current generation unit 13*a* which generates the second bias current IEXT.

The reference voltage VBGR is transmitted to a negative input of the second amplifier 121_2. A positive input of the second amplifier 121_2 is connected a node between the third transistor TR3 and the first variable resistor VR1. The first variable resistor VR1 is connected between the third transistor TR3 and the ground node. A code "CODE" is transmitted to the first variable resistor VR1. The first variable resistor VR1 may have a resistance value which varies with the code "CODE". The third transistor TR3 is connected between the power node supplied with the power supply voltage VDD and the first variable resistor VR1.

The second amplifier 121_2 may amplify a difference between the reference voltage VBGR and a fifth voltage V5 of a node between the third transistor TR3 and the first variable resistor VR1 and may output a sixth voltage V6. The sixth voltage V6 is transmitted to a gate of the third transistor TR3. The second amplifier 121_2, the first variable resistor VR1, and the third transistor TR3 may constitute a feedback loop for uniformly maintaining the fifth voltage V5 at the same level as the reference voltage VBGR and adjusting the amount of a third current I3 flowing through the first variable resistor VR1 and the third transistor TR3 to a value obtained by dividing the reference voltage VBGR by a resistance value of the first variable resistor VR1. A level of the fifth voltage V5 becomes the same as a level of the reference voltage VBGR regardless of a resistance value of the first variable resistor VR1. The amount of the third current I3 may vary with the resistance value of the first variable resistor VR1.

The fourth transistor TR4 is connected between the power node and the second multiplexer 122_2. The sixth voltage V6 is transmitted to a gate of the fourth transistor TR4. The fourth transistor TR4 may mirror and output the third current I3.

For example, in the first operating mode (e.g., the calibration mode), the second multiplexer 122_2 may connect a first node "S" with a second node "A". The fourth transistor TR4 may supply the mirrored current as a fourth current I4 to the calibration unit 14*a*.

In the second operating mode (e.g., the normal operating mode), the second multiplexer 122_2 may connect the first node "S" with a third node "B". The fourth transistor TR4 may supply the mirrored current as the second bias current IEXT to the peripheral block 130.

The third amplifier 121_3, the second resistor R2, and the calibration logic 123 of the bias current generation block 120*a* in the integrated circuit 100*a* may constitute the calibration unit 14*a* which calibrates the first bias current IP to generate the code "CODE" in the first operating mode. The code "CODE" may be used to generate the second bias current IEXT in the second operating mode.

The second resistor R2 is connected between the ground node and the second node "A" of the first multiplexer 122_1. A negative input of the third amplifier 121_3 may receive a third voltage V3 of a node between the second node "A" of the first multiplexer 122_1 and the second resistor R2. A positive input of the third amplifier 121_3 may receive a fourth voltage V4 of a node between the second node "A" of the second multiplexer 122_2 and the third resistor R3.

An output of the third amplifier 121_3 is transmitted to the calibration logic 123. The calibration logic 123 may generate the code "CODE" from the output of the third amplifier 121_3. Also, the calibration logic 123 may control the first operating mode (i.e., the calibration mode) and the second operating mode (i.e., the normal operating mode) of the bias current generation block 120*a*. For example, the calibration logic 123 may control the first and second multiplexers 122_1 and 122_2. For the simplicity of drawings, connections between the calibration logic 123 and the first and second multiplexers 122_1 and 122_2 are omitted in FIG. 1, but an ordinary skilled person in the art would know with reasonable clarity from the above description and FIG. 1 that the calibration logic 123 may control the first and second multiplexers 122_1 and 122_2 according to one of the first operating mode and the second operating mode.

Below, operations of the first operating mode (i.e., the calibration mode) of the bias current generation block 120*a* will be described. In the first operating mode, the first multiplexer 122_1 may connect the first node "S" with the second node "A". The second transistor TR2 may mirror the first current I1 to supply the second current I2 to the second resistor R2.

The third voltage V3 may be generated by the second resistor R2 when the second current I2 flows through the second resistor R2. For example, the first current I1 may be expressed by a ratio VBGR/R1 of the reference voltage VBGR to the first resistor R1. In the case where the sizes of the first and second transistors TR1 and TR2 are the same, since the second current I2 is the same as the first current I1, the third voltage V3 may be calculated by Equation 1.

$$V3 = VBGR \cdot \frac{R2}{R1} \quad \text{[Equation 1]}$$

In Equation 1, both the first resistor R1 and the second resistor R2 may be fabricated within the integrated circuit 100*a* by using a same material such as a polycrystalline silicon and a doped polycrystalline silicon. Accordingly, the first and second resistors R1 and R2 may have a characteristic in which process variations are the same applied. For example, the first and second resistors R1 and R2 may have substantially the same resistance of which value may vary according to a process variation. The third voltage V3 which is calculated according to a ratio of the first and second resistors R1 and R2 has a characteristic in which process variations are offset and thus the process variations need not affect the value of the third voltage V3. In Equation 1, when the resistance value of the first resistor R1 is the same as the resistance value of the second resistor R2, the third voltage V3 may have the same level as the reference voltage VBGR.

The third current I3 flowing through the third transistor TR3 or the first variable resistor VR1 may be expressed by a ratio VBGR/VR1 of the reference voltage VBGR to the first variable resistor VR1. In the first operating mode, the second multiplexer 122_2 of the second current generation unit 13*a* may connect the first node "S" with the second node "A".

For example, in the first operating mode, the fourth transistor TR4 may mirror the third current I3 to supply the fourth current I4 to the third resistor R3. In the case where the sizes of the third and fourth transistors TR3 and TR4 are the same, the fourth current I4 is the same as the third current I3, and the fourth voltage V4 may be calculated by Equation 2.

$$V4 = VBGR \cdot \frac{R3}{VR1} \quad \text{[Equation 2]}$$

In Equation 2, the first variable resistor VR1 may be subject to the process variations, but the third resistor R3 is an external resistor of the integrated circuit 100*a*, which has no influence of the process variations. Accordingly, the fourth voltage V4 has a characteristic in which the process variations are not offset and thus the fourth voltage V4 may vary according to the process variations.

The third amplifier 121_3 may compare the third voltage V3 that is not affected by the process variations and the fourth voltage V4 that is affected by the process variations. The output of the third amplifier 121_3 may represent a voltage difference due to the process variations. The calibration logic 123 may generate the code "CODE" (e.g., a calibrated code) for adjusting the resistance value of the first variable resistor VR1 such that the third voltage V3 is the same as the fourth voltage V4, with reference to the output of the third amplifier 121_3 according to the code "CODE" of the first variable resistor VR1. By the calibrated code, the first variable resistor VR1 may have a resistance value in which a process variation is removed. The calibrated resistance value of the first variable resistor VR1 may be calculated by Equation 3.

$$\text{Equation 1} = \text{Equation 2} \quad \text{[Equation 3]}$$

$$VBGR \cdot \frac{R2}{R1} = VBGR \cdot \frac{R3}{VR1}$$

$$VR1 = R3 \cdot \frac{R1}{R2}$$

For example, since the resistance value of the first resistor R1 is the same as the resistance value of the second resistor R2, when the first variable resistor VR1 is adjusted to have the same resistance value of the third resistor R3 as expressed in Equation 4 below, the calibration logic 123 may generate the code "CODE" (e.g., the calibrated code or calibration code) for calibrating the resistance value of the first variable resistor VR1 so as to be the same as the resistance value of the third resistor R3 being an external resistor. In this case, the process variations may be applied to the code "CODE". In other words, the code "CODE" may represent the process variations. The resistance value of the first variable resistor VR1 may be calibrated by the calibrated code CODE and may be maintained.

$$VR1 = R3 \text{ (in the case of } R1 = R2) \quad \text{[Equation 4]}$$

In the second operating mode, the first multiplexer 122_1 may connect the first node "S" with the third node "B". The second transistor TR2 may mirror and output the first current I1 as the first bias current IP. The first bias current IP is generated from the first resistor R1 to which the process variations are applied. Accordingly, the first bias current IP may be a relative current to which the process variations are applied.

In the second operating mode, the second multiplexer 122_2 may connect the first node "S" with the third node "B". The fourth transistor TR4 may mirror and output the third current I3 as the second bias current IEXT. The second bias current IEXT is generated from the first variable resistor VR1 in which the process variations are calibrated. Accordingly, the second bias current IEXT may be calibrated to be an absolute current of which a current amount is not affected by the process variations.

The calibration logic 123 may output the code "CODE" (e.g., the calibrated code) to the peripheral block 130. For example, the bias current generation block 120*a* may transmit the first bias current IP, the second bias current IEXT, or the code "CODE" (e.g., the calibrated code) to the peripheral block 130. For example, the bias current generation block 120*a* may generate, in the first operating mode, the code "CODE" to the peripheral block 130 and, in the second operating mode, the first bias current IP and the second bias current IEXT.

The peripheral block 130 may receive the first bias current IP, the second bias current IEXT, or the code "CODE" (e.g., the calibrated code) from the bias current generation block 120*a*. The peripheral block 130 may include first to fourth sub-blocks 131 to 134 which perform specific operations by using the first bias current IP, the second bias current IEXT, or the code "CODE" (e.g., the calibrated code). Examples of the first to fourth sub-blocks 131 to 134 will be described with reference to FIGS. 18 to 20.

The peripheral block 130 may be connected with a wiring of the device board 11*a* through a second connection pad 135. The second connection pad 135 may be connected with a first port 15 through a wiring of the device board 11*a*. The first port 15 may be connected with an external device. For example, the peripheral block 130 may exchange data, signals, commands, etc. with the external device through the second connection pad 135 and the first port 15.

As described with reference to FIG. 1, the bias current generation block 120*a* of the semiconductor device 10*a* according to an exemplary embodiment of the inventive concept may generate the second current I2 necessary for calibration by using one amplifier, that is, the first amplifier 121_1 and may generate the first bias current IP. Also, the bias current generation block 120*a* may generate the third current I3 necessary for calibration by using one amplifier, that is, the second amplifier 121_2, may perform the calibration, and may generate the second bias current IEXT.

Figure 2:
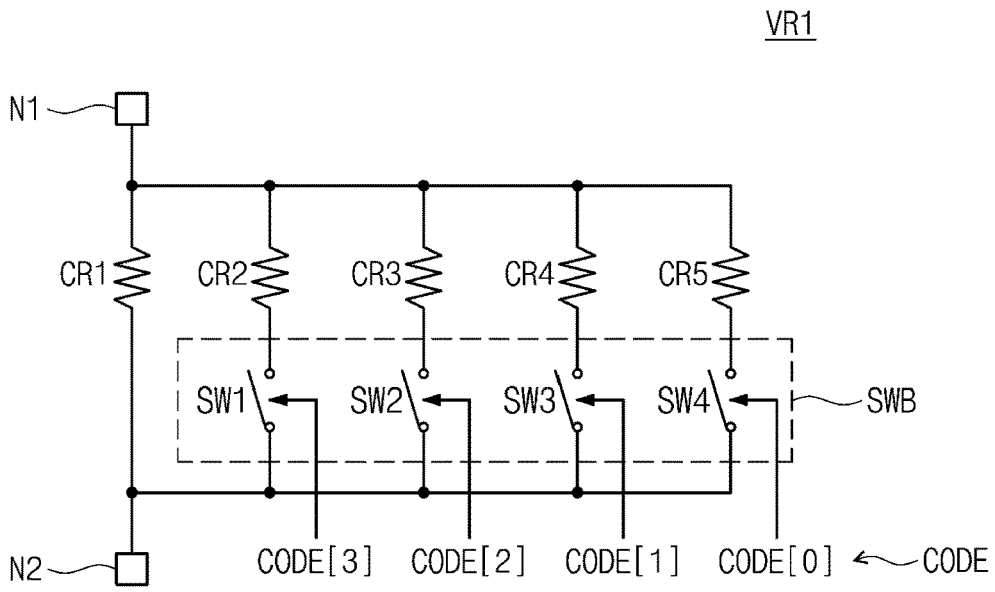
FIG. 2 is a diagram illustrating an example of a first variable resistor of a second current generation unit of FIG. 1.

FIG. 2 is a diagram illustrating an example of the first variable resistor VR1 of the second current generation unit 13*a* of FIG. 1. In an embodiment, an example in which a resistance value of the first variable resistor VR1 is controlled by a 4-bit binary code is illustrated in FIG. 2. Referring to FIGS. 1 and 2, the first variable resistor VR1 may include first to fifth calibration resistors CR1 to CR5 and a switch unit SWB.

Figure 4:
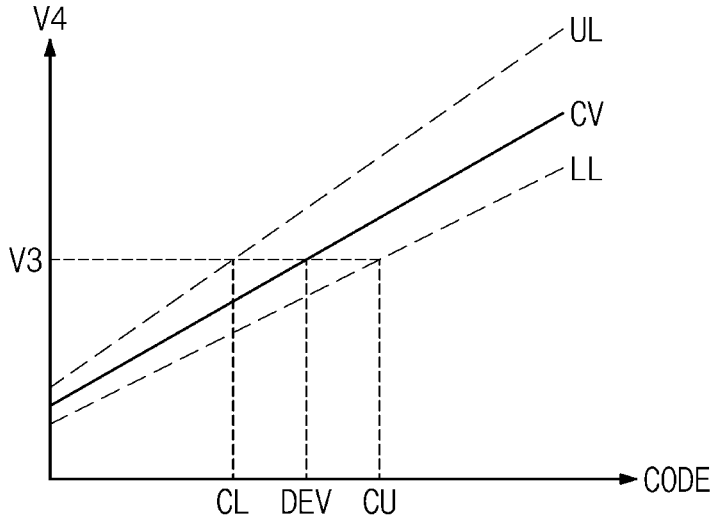
FIG. 4 is a diagram illustrating an example in which a fourth voltage of FIG. 1 varies with process variations.

The first calibration resistor CR1 is connected between a first node N1 and a second node N2. The first calibration resistor CR1 may be referred to as a base calibration resistor. The first node N1 may be connected with the third transistor TR3. The second node N2 may be connected with the ground node. In operation, the first calibration resistor CR1 is always connected between the first node N1 and the second node N2 regardless of a value of the code "CODE". A resistance value of the first calibration resistor CR1 may determine, for example, an intercept value of a vertical axis of FIG. 4 in which the fourth voltage V4 is shown according to the value of the code "CODE". FIG. 4 will be described in more detail.

In operation, the second to fifth calibration resistors CR2 to CR5 may be selectively connected between the first node N1 and the second node N2 depending on a value of the code "CODE". Resistance values of the second to fifth calibration resistors CR2 to CR5 may determine, for example, a slope in the graph of FIG. 4 in which the fourth voltage V4 is shown according to the value of the code "CODE".

The resistance values of the second to fifth calibration resistors CR2 to CR5 may be determined in ratios of 1:2:4:8 depending on binary weights. In the case where the resistance values of the second to fifth calibration resistors CR2 to CR5 are determined depending on the binary weights, the resistance value of the first variable resistor VR1 may be adjusted in a binary manner.

However, the resistance values of the second to fifth calibration resistors CR2 to CR5 are not limited as being determined depending on the binary weights. The resistance values of the second to fifth calibration resistors CR2 to CR5 may be variously determined depending on a manner of adjusting the resistance value of the first variable resistor VR1.

The second calibration resistor CR2 may be connected between the first node N1 and the second node N2 together with a first switch SW1 corresponding to the second calibration resistor CR2 among switches of the switch unit SWB. The first switch SW1 may be controlled by a third bit (e.g., CODE[3]) being the most significant bit of the code "CODE".

The third calibration resistor CR3 may be connected between the first node N1 and the second node N2 together with a second switch SW2 corresponding to the third calibration resistor CR3 among the switches of the switch unit SWB. The second switch SW2 may be controlled by a second bit (e.g., CODE[2]) of the code "CODE".

The fourth calibration resistor CR4 may be connected between the first node N1 and the second node N2 together with a third switch SW3 corresponding to the fourth calibration resistor CR4 among the switches of the switch unit SWB. The third switch SW3 may be controlled by a first bit (e.g., CODE[1]) of the code "CODE".

The fifth calibration resistor CR5 may be connected between the first node N1 and the second node N2 together with a fourth switch SW4 corresponding to the fifth calibration resistor CR5 among the switches of the switch unit SWB. The fourth switch SW4 may be controlled by a 0-th bit (e.g., CODE[)]) being the least significant bit of the code "CODE".

The switches of the switch unit SWB may be controlled by the code "CODE". The first to fourth switches SW1 to SW4 of the switch unit SWB may be individually turned on or turned off by the bits CODE[3] to CODE[0] of the code "CODE". When a specific switch is turned on, a calibration resistor associated with the turned-on switch may be connected between the first node N1 and the second node N2. That is, the resistance value of the first variable resistor VR1 may decrease compared to the first calibration resistor CR1. When all switches SW1 to SW4 are turned off, the first variable resistor VR1 is equal to the first calibration resistor CR1. Depending on the switches turned on, the resistance value of the first variable resistor VR1 may decrease from the resistance value of the first calibration resistor CR1.

When the specific switch is turned off, the calibration resistor associated with the turned-off switch may not be connected between the first node N1 and the second node N2. That is, the resistance value of the first variable resistor VR1 may increase. In an embodiment, the first to fourth switches SW1 to SW4 may be implemented with transistors.

Figure 3:
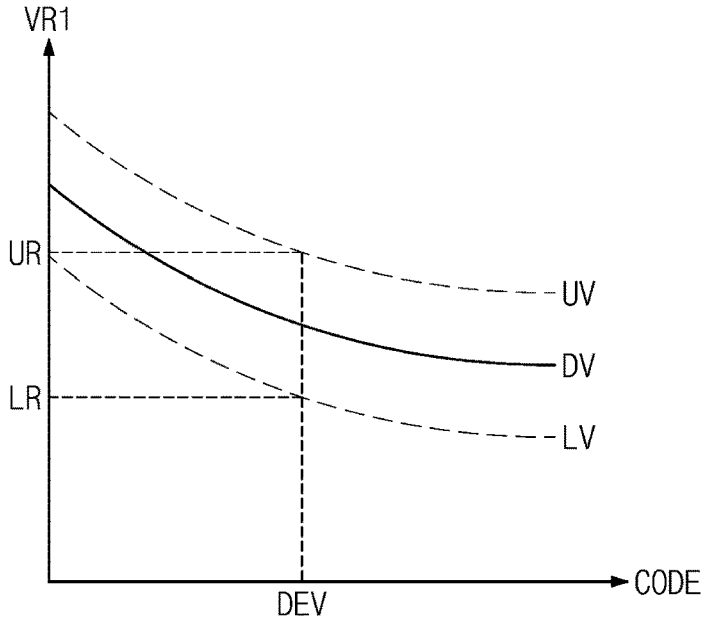
FIG. 3 is a diagram illustrating an example in which a resistance value of a first variable resistor varies with process variations.

FIG. 3 is a diagram illustrating an example in which a resistance value of the first variable resistor VR1 varies with process variations. In FIG. 3, a horizontal axis represents a value of the code "CODE", and a vertical axis represents a resistance value of the first variable resistor VR1. Referring to FIGS. 1 and 3, the first variable resistor VR1 may be configured to have a resistance value which decreases as a value of the code "CODE" increases.

In FIG. 3, a designed value DEV shows how a target resistance value targeted upon designing the first variable resistor VR1 varies with the code "CODE". An upper limit value UV shows a maximum resistance value of the first variable resistor VR1, which becomes higher than the target resistance value due to a process variation. A lower limit value LV shows a minimum resistance value of the first variable resistor VR1, which becomes lower than the target resistance value due to a process variation.

As illustrated in FIG. 3, the resistance value of the first variable resistor VR1 may vary due to the process variation. For an arbitrary value DEV of the code "CODE," for example, the resistance value of the first variable resistor VR1 may have a value which is between a lower resistance value LR corresponding to the lower limit value LV and an upper resistance value UR corresponding to the upper limit value UV.

FIG. 4 is a diagram illustrating an example in which the fourth voltage V4 of FIG. 1 varies with process variations. In FIG. 4, a horizontal axis represents a value of the code "CODE", and a vertical axis represents the fourth voltage V4. Referring to FIGS. 1 and 4, since the fourth voltage V4 and a resistance value of the first variable resistor VR1 are reciprocal, the fourth voltage V4 may increase in direct proportion to a value of the code "CODE."

The resistance value of the first variable resistor VR1 affected by process variations may be calibrated at a specific value of the cod "CODE" such that such process variations are removed. When the resistance value of the first variable resistor VR1 changes, the fourth voltage V4 may also change. For example, in FIG. 4, a lower limit LL and an upper limit UL of the fourth voltage V4 according to process variations are illustrated by dotted lines.

As described with reference to FIG. 1, for example, like Equation 4, when resistance values of the first and second resistors R1 and R2 are the same, the code "CODE" (e.g., the calibrated code) may be generated such that the fourth voltage V4 is the same as the third voltage V3, that is, such that the resistance value of the first variable resistor VR1 is the same as the resistance value of the third resistor R3. In the case where the fourth voltage V4 corresponds to the lower limit LL, the fourth voltage V4 is the same as the third voltage V3 when a value of the code "CODE" is an upper limit CU. That is, the resistance value of the first variable resistor VR1 is the same as the resistance value of the third resistor R3.

In the case where the fourth voltage V4 corresponds to the upper limit UL, the fourth voltage V4 is the same as the third voltage V3 when a value of the code "CODE" is a lower limit CL. That is, the resistance value of the first variable resistor VR1 is the same as the resistance value of the third resistor R3. To make the fourth voltage V4 the same as the third voltage V3, that is, to make the resistance value of the first variable resistor VR1 the same as the resistance value of the third resistor R3, the code "CODE" (e.g., the calibrated code) may have a value between the lower limit CL and the upper limit CU.

In an embodiment, when the fourth voltage V4 corresponds to an arbitrary value CV between the lower limit LL and the upper limit UL, the code "CODE" (e.g., the calibrated code) may be set to a specific value DEV between the lower limit CL and the upper limit CU.

Figure 5:
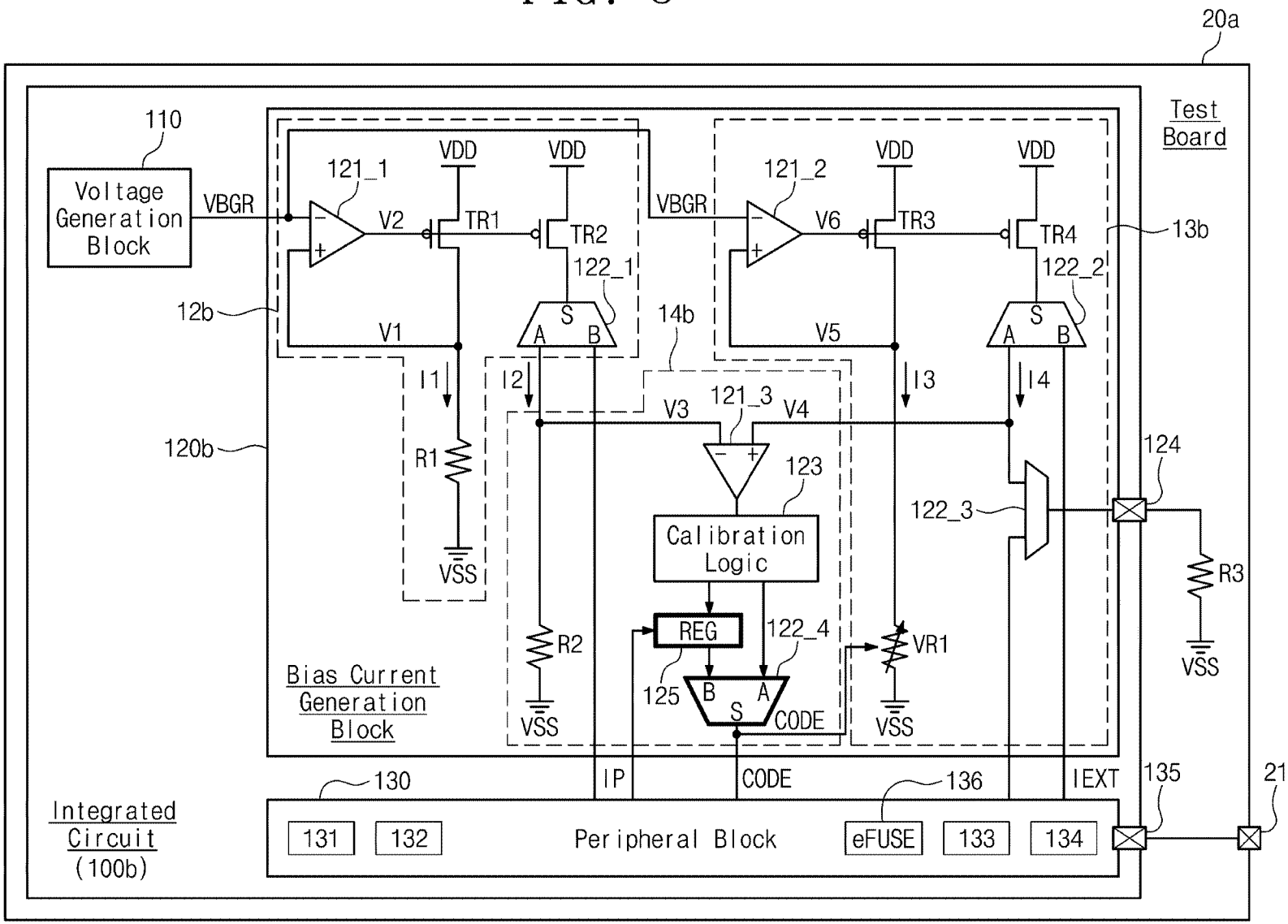
FIG. 5 is a diagram illustrating an integrated circuit and a test board according to a second embodiment of the inventive concept.

FIG. 5 is a diagram illustrating an integrated circuit 100*b* and a test board 20*a* according to an exemplary embodiment of the inventive concept. For a brief description, components which are different from the components of the integrated circuit 100*a* of FIG. 1 are marked by a bold line. Referring to FIG. 5, the integrated circuit 100*b* and the third resistor R3 may be positioned on the test board 20*a*. The integrated circuit 100*b* includes the voltage generation block 110, a bias current generation block 120*b*, and the peripheral block 130. The third resistor R3 on the test board 20*a* may be referred to as an external resistor.

A first current generation unit 12*b* of FIG. 5 may have the same configuration as the first current generation unit 12*a* of FIG. 1 and may operate the same as the first current generation unit 12*a* of FIG. 1. Thus, additional description associated with the first current generation unit 12*b* will be omitted to avoid redundancy.

Compared to the second current generation unit 13*a* of FIG. 1, the integrated circuit 100*b* and the third resistor R3 of FIG. 5 are positioned on the test board 20*a*. The second node "A" of the second multiplexer 122_2 may be connected with the third resistor R3 through a third multiplexer 122_3 and the first connection pad 124. The third resistor R3 is connected between the first connection pad 124 and the ground node.

The third multiplexer 122_3 may electrically connect the first connection pad 124 with one of the second multiplexer 122_2 and the peripheral block 130. For example, in a test operation including the calibration mode for calibrating a resistance value of the first variable resistor VR1, the third multiplexer 122_3 may connect the second node "A" of the second multiplexer 122_2 with the third resistor R3 through the first connection pad 124.

Upon conveying the code "CODE" in the test operation or after the test operation is completed, the third multiplexer 122_3 may electrically connect the first connection pad 124 with the peripheral block 130. In the normal operating mode when the integrated circuit 100*b* is removed from the test board 20*a* and operated in an application system, for example, the third multiplexer 122_3 may connect the first connection pad 124 to the peripheral block 130, thereby delivering a signal from the external to the peripheral block 130 or outputting a signal from the peripheral block 130 to the external. In FIG. 5, the first connection pad 124 and the third multiplexer 122_3 are positioned within or adjacent to a second current generation unit 13*b*, but the present inventive concept is not limited thereto. For example, the first connection pad 124 and the third multiplexer 122_3 may be positioned within or adjacent to the peripheral block 130.

Compared with the calibration unit 14*a* of FIG. 1, a calibration unit 14*b* of FIG. 5 further includes a register 125 and a fourth multiplexer 122_4. The code "CODE" (e.g., the calibrated code) generated by the calibration logic 123 may be transmitted to the register 125 and the fourth multiplexer 122_4. The register 125 may store the code "CODE" (e.g., the calibrated code) transmitted from the calibration logic 123.

A first node "S" of the fourth multiplexer 122_4 may output the code "CODE" to the first variable resistor VR1. A second node "A" of the fourth multiplexer 122_4 may receive an output of the calibration logic 123. A third node "B" of the fourth multiplexer 122_4 may receive an output of the register 125.

The fourth multiplexer 122_4 may operate in one of the first operating mode (i.e., the calibration mode) and the second operating mode (i.e., the normal operating mode) under control of the calibration logic 123. In the first operating mode, the fourth multiplexer 122_4 may connect the first node "S" with the second node "A". That is, the fourth multiplexer 122_4 may transmit the code "CODE" from the calibration logic 123 to the first variable resistor VR1. In the first operating mode, the register 125 may store the code "CODE" output from the calibration logic 123.

In the second operating mode, the fourth multiplexer 122_4 may connect the first node "S" with the third node "B". In the second operating mode, the register 125 may output the stored code "CODE" to the fourth multiplexer 122_4. That is, in the second operating mode, the code "CODE" stored in the register 125 may be transmitted to the first variable resistor VR1.

The peripheral block 130 may be connected with a first test port 21 through the second connection pad 135. The first test port 21 of the test board 20*a* may be connected with an external test device. The integrated circuit 100*b* may be tested through the first test port 21 of the test board 20*a*.

In an embodiment, after the integrated circuit 100*b* is fabricated, the integrated circuit 100*b* may be tested through the test board 20*a*. For example, the integrated circuit 100*b* may be fabricated and tested in the form of a semiconductor die or a semiconductor package. When the calibrated integrated circuit 100*b* may be coupled with the device board 11*a* as shown in FIG. 1, the third resistor R3 may be omitted from the device board 11*a* because the calibrated integrated circuit 100*b* may store the code "CODE" generated in the calibration mode. For example, when the semiconductor device 10*a* including the calibrated integrated circuit 100*b* operates (in other words, the calibrated integrated circuit 100*b* is in the normal operating mode), a resistance value of the first variable resistor VR1 may be set according to the code "CODE" stored in an electrical fuse 136 such that the second bias current IEXT is generated to have a target value irrespective of process variations without using the third resistor R3.

In the test operation, the integrated circuit 100*b* may enter the first operating mode. The calibration logic 123 may generate the code "CODE" (e.g., the calibrated code). A resistance value of the first variable resistor VR1 may be adjusted by the code "CODE". The register 125 may store the code "CODE" (e.g., the calibrated code).

The peripheral block 130 may further include the electrical fuse 136 for storing the code "CODE" (e.g., the calibrated code) in the calibration code. The present inventive concept is not limited thereto. For example, the peripheral block 130 may include a non-volatile memory such as a programmable read-only memory (PROM) and a one-time programmable read-only memory (OTP ROM) other than the electrical fuse 136. The peripheral block 130 may output the code "CODE" (e.g., the calibrated code) through the third multiplexer 122_3 and the first connection pad 124 or through the second connection pad 135.

The code "CODE" (e.g., the calibrated code) may be programmed to the electrical fuse 136 through the first connection pad 124 or the second connection pad 135 or through separate means provided for the electrical fuse 136.

When the test operation is completed, the integrated circuit 100*b* may be separated from the test board 20*a*. That is, the integrated circuit 100*b* may be separated from the third resistor R3. After the test operation is completed, a power may be supplied to the integrated circuit 100*b*. Even though the third resistor R3 does not exist, the peripheral block 130 may read the code "CODE" (e.g., the calibrated code) stored in the electrical fuse 136 and may provide the code "CODE" to the register 125. A resistance value of the first variable resistor VR1 may be controlled (or adjusted) by the code "CODE" (e.g., the calibrated code) stored in the register 125. For example, in the normal operating mode, the peripheral block 130 may output the code "CODE" (e.g., the calibrated code) from the electrical fuse 136 to the first variable resistor VR1 through the register 125 and the fourth multiplexer 122_4. In this case, the first variable resistor VR1 may be set according to a value of the code "CODE" stored in the electrical fuse 136. In an example embodiment, the integrated circuit 100*b* may be mounted on the device board 11*a* to form the semiconductor device 10*a* as shown in FIG. 1. In this case, the third resistor R3 may be omitted from the device board 11*a*.

The integrated circuit 100*b* according to an embodiment of the inventive concept includes the electrical fuse 136. The electrical fuse 136 may retain the code "CODE" (e.g., the calibrated code) even though the power of the integrated circuit 100*b* is removed. When the power is supplied to the integrated circuit 100*b*, the integrated circuit 100*b* may obtain the code "CODE" (e.g., the calibrated code) from the electrical fuse 136 instead of obtaining the code "CODE" by performing the test operation using the third resistor R3.

The first operating mode (e.g., the calibration mode) may be performed only in the test operation, for example, only once. After the first operating mode is completed, the third resistor R3 is removed. After the third resistor R3 is removed, that is, after the test operation is completed, the first operating mode may be inhibited. In an example embodiment, the calibrated integrated circuit 100*b* after being removed from the test board 20*a* may be mounted on the device board 11*a* without having the third resistor R3.

In an embodiment, after the test board 20*a* is removed, the first connection pad 124 may be used for another purpose. After the test board 20*a* is removed, the first connection pad 124 may be used to receive a reference clock signal REFCLK which is supplied from an external device to the integrated circuit 100*b*. For example, the peripheral block 130 may receive the reference clock signal REFCLK through the first connection pad 124 and the third multiplexer 122_3.

The use of the first connection pad 124 after the test operation is completed is not limited to receive the reference clock signal REFCLK. After the test operation is completed, the first connection pad 124 may be used to convey at least one signal of various signals exchanged between the peripheral block 130 and an external device connected to the integrated circuit 100*b*.

Figure 6:
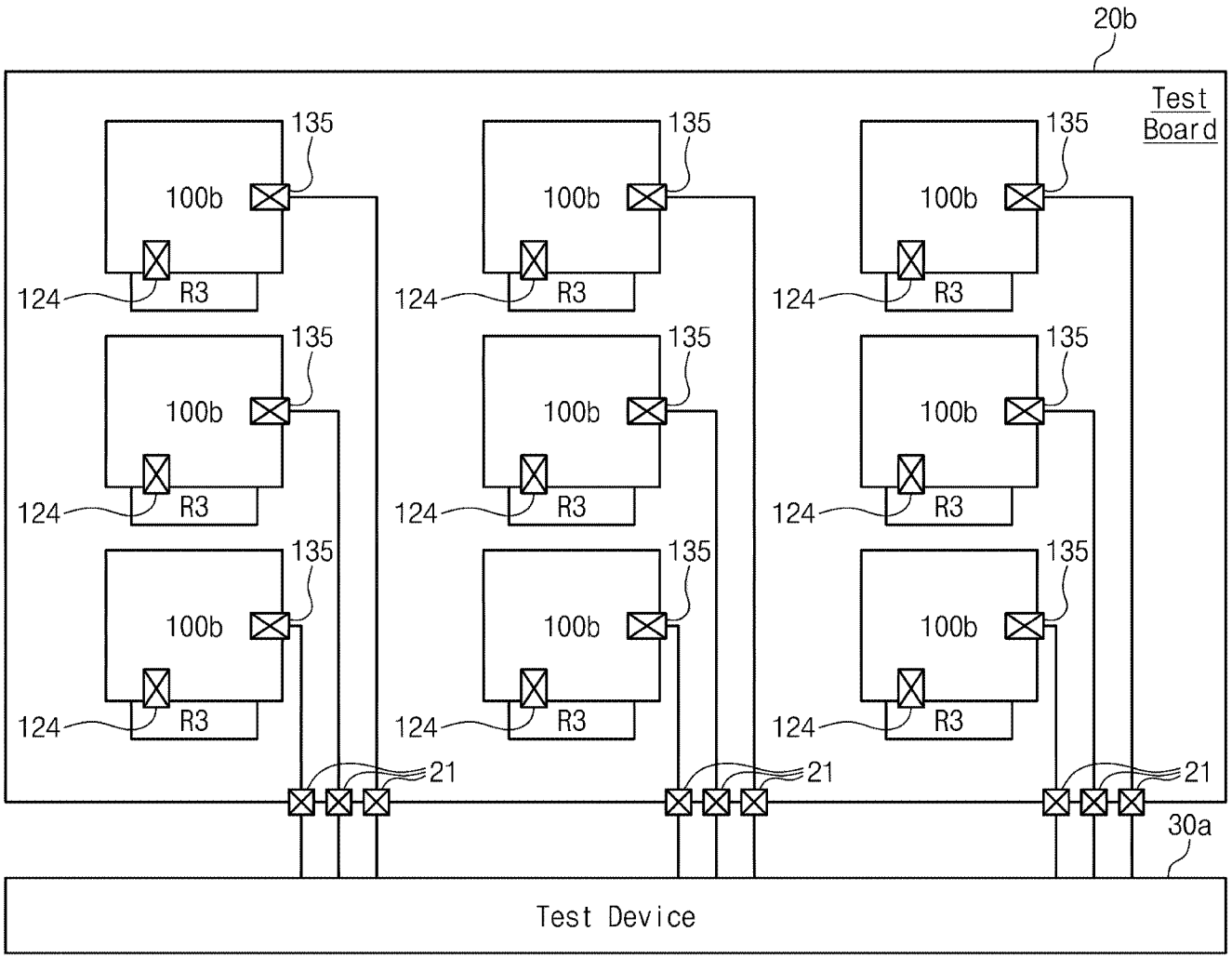
FIG. 6 is a diagram illustrating an example in which integrated circuits are attached to a test board and are tested.

FIG. 6 is a diagram illustrating an example in which the integrated circuits 100*b* are attached to a test board 20*b* and are tested. Referring to FIG. 6, two or more integrated circuits 100*b* may be coupled to the test board 20*b*. The integrated circuits 100*b* may be respectively connected with the third resistors R3 positioned at the test board 20*b* through the first connection pads 124. The second connection pads 135 of the integrated circuits 100*b* may be connected with the first test ports 21 of the test board 20*b* through wirings of the test board 20*b*.

A test device 30*a* may be coupled to the first test ports 21 of the test board 20*b*. The test device 30*a* may simultaneously test the integrated circuits 100*b* through the first test ports 21. For example, the test device 30*a* may receive codes (e.g., calibrated codes) from the integrated circuits 100*b* and may program the codes (e.g., the calibrated codes) to the electrical fuses 136 of the integrated circuits 100*b*, respectively. When the test operation is completed, the integrated circuits 100*b* may be separated from the test board 20*b*.

Figure 7:
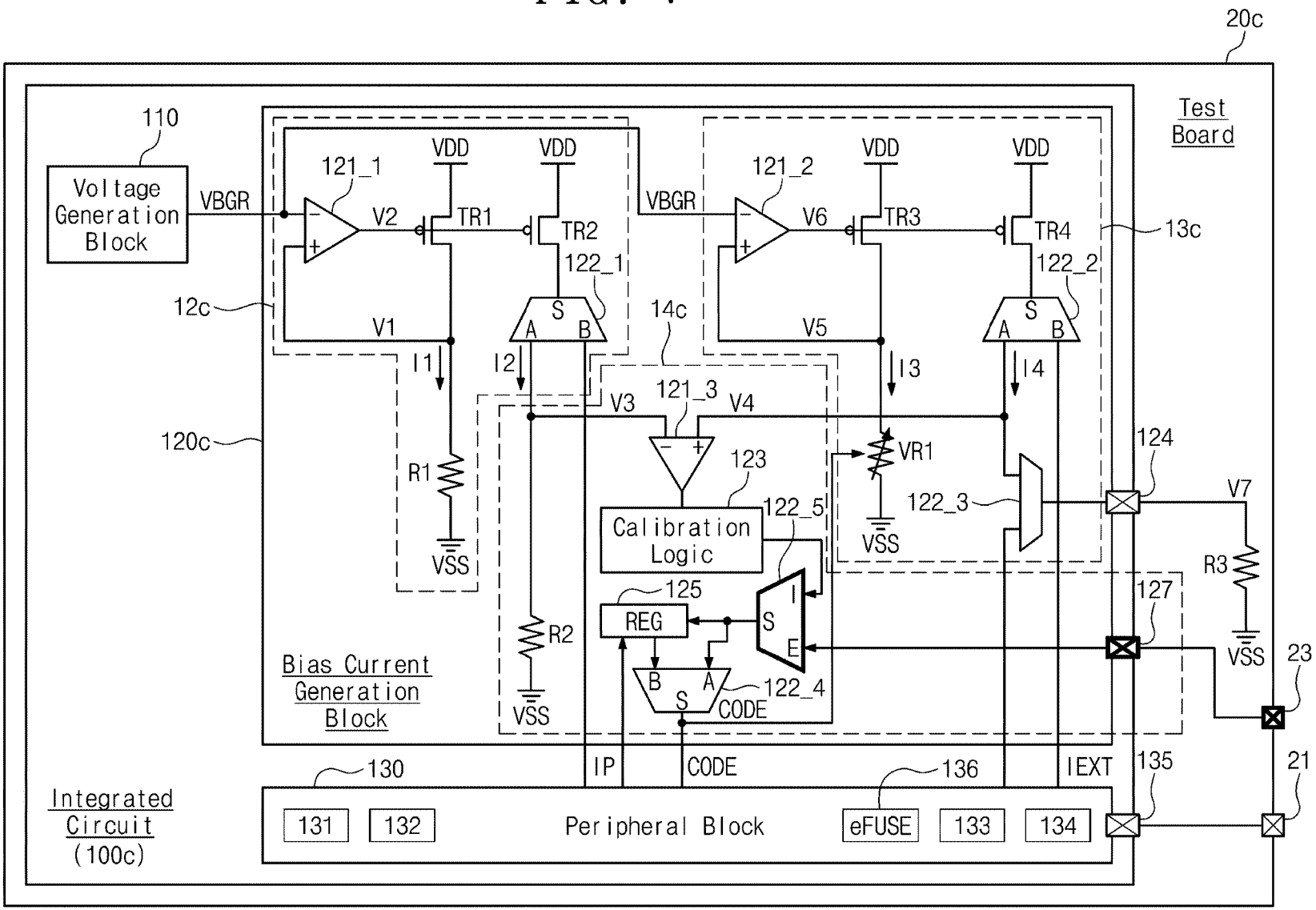
FIG. 7 is a diagram illustrating an integrated circuit and a test board according to a third embodiment of the inventive concept.

FIG. 7 is a diagram illustrating an integrated circuit 100*c* and a test board 20*c* according to a third embodiment of the inventive concept. For a brief description, components which are different from the components of the integrated circuit 100*b* of FIG. 5 are marked by a bold line. Referring to FIG. 7, the integrated circuit 100*c* and the third resistor R3 may be positioned on the test board 20*c*. The integrated circuit 100*c* includes the voltage generation block 110, a bias current generation block 120*c*, and the peripheral block 130.

A first current generation unit 12*c* of FIG. 7 may have the same configuration as the first current generation unit 12*b* of FIG. 5 and may operate the same as the first current generation unit 12*b* of FIG. 5. Thus, additional description associated with the first current generation unit 12*c* will be omitted to avoid redundancy. A second current generation unit 13*c* of FIG. 7 may have the same configuration as the second current generation unit 13*b* of FIG. 5 and may operate the same as the second current generation unit 13*b* of FIG. 5. Thus, additional description associated with the second current generation unit 13*c* will be omitted to avoid redundancy.

Compared with the calibration unit 14*b* of FIG. 5, a calibration unit 14*c* of FIG. 7 further includes a fifth multiplexer 122_5 and a third connection pad 127. The third connection pad 127 may be connected to a third node "E" of the fifth multiplexer 122_5. The third node "E" of the fifth multiplexer 122_5 is connected with a second test port 23 of the test board 20*c* through the third connection pad 127.

In an embodiment, the first operating mode (i.e., the calibration mode) of the bias current generation block 120*c* may include a first sub-operating mode (e.g., an internal calibration mode) and a second sub-operating mode (e.g., an external calibration mode) under control of an external test device. In the first sub-operating mode (e.g., the internal calibration mode), the fifth multiplexer 122_5 may connect a first node "S" with a second node "I".

In the first sub-operating mode (i.e., the internal calibration mode), the calibration logic 123 may output the code "CODE" to the register 125 and the fourth multiplexer 122_4 through the fifth multiplexer 122_5. In the first sub-operating mode (i.e., the internal calibration mode), the fourth multiplexer 122_4 may output the code "CODE" transmitted from the calibration logic 123 to the first variable resistor VR1.

When the first sub-operating mode (i.e., the internal calibration mode) is completed, the code "CODE" (e.g., the calibrated code) may be programmed to the electrical fuse 136. In the second operating mode (i.e., the normal operating mode), the peripheral block 130 may provide the code "CODE" (e.g., the calibrated code) stored in the electrical fuse 136 to the register 125. In the second operating mode, the fourth multiplexer 122_4 may transmit the code "CODE" stored in the register 125 to the first variable resistor VR1.

In the second sub-operating mode (i.e., the external calibration mode), an external test device may generate the code "CODE" and may provide the code "CODE" to the register 125 through the third connection pad 127. For example, the external test device may provide the code "CODE" for test for checking a process variation of the first variable resistor VR1 to the register 125. The code "CODE" may be transmitted to the first variable resistor VR1 through the fifth multiplexer 122_5 and the fourth multiplexer 122_4.

The external test device may measure a seventh voltage V7 of the third resistor R3 of the test board 20*c*, which is adjusted according to the code "CODE". The seventh voltage V7 may be a voltage of the same location (e.g., same node) as the fourth voltage V4 in the first sub-operating mode (i.e., the internal calibration mode). The seventh voltage V7 is determined by Equation 2. When the seventh voltage V7 is the same as the reference voltage VBGR, a resistance value of the first variable resistor VR1 is the same as a resistance value of the third resistor R3.

The external test device may generate the code "CODE" (e.g., the calibrated code), which may be used to adjust the seventh voltage V7 to the reference voltage VBGR, by using the seventh voltage V7 generated based on the code "CODE" of the external test device. As described with reference to FIG. 4, the seventh voltage V7 may be in direct proportion to a value of the code "CODE".

The external test device may adjust a value of the code "CODE" to any two values and may measure levels of the seventh voltage V7 depending on the two values. The external test device may perform linear approximation on the two values of the code "CODE" and the measured levels of the seventh voltage V7 to calculate a slope of the seventh voltage V7 for the graph in FIG. 4. The external test device may calculate the code "CODE" (e.g., the calibrated code) depending on the calculated slope to allow the seventh voltage V7 to be the same as the reference voltage VBGR (or the third voltage V3).

The external test device may provide the code "CODE" (e.g., the calibrated code) to the register 125 and the fourth multiplexer 122_4 through the second test port 23, the third connection pad 127 and the fifth multiplexer 122_5. The external test device may program the code "CODE" (e.g., the calibrated code) to the electrical fuse 136.

In the second operating mode (i.e., the normal operating mode), the peripheral block 130 may provide the code "CODE" (e.g., the calibrated code) programmed to the electrical fuse 136 to the register 125. In the second operating mode, the fourth multiplexer 122_4 may transmit the code "CODE" stored in the register 125 to the first variable resistor VR1.

The external test device may perform a function which is similar to a function of the first current generation unit 12*c* and the calibration unit 14*c*. The second sub-operating mode (i.e., the external calibration mode) may be performed to exclude a mismatch or offset influence of the third amplifier 121_3, which occurs in the first sub-operating mode (i.e., the internal calibration mode).

Also, the second sub-operating mode (i.e., the external calibration mode) may be performed to exclude an influence of an ohmic contact of the first connection pad 124, which occurs in the first sub-operating mode (i.e., the internal calibration mode). Accordingly, the code "CODE" may be calculated more finely in the second sub-operating mode.

In an embodiment, the third connection pad 127 to which the code "CODE" is transmitted may be a general purpose input and output (GPIO) pad. For another example, the third connection pad 127 to which the code "CODE" is transmitted may be a part of a channel complying with the standard such as an inter-integrated circuit (I2C) or an advanced peripheral bus (APB).

In an embodiment, the third connection pad 127 to which the code "CODE" is transmitted may be shared by the first to fourth sub-blocks 131 to 134 of the peripheral block 130 or any other components. For example, the third connection pad 127 may be integrated with the second connection pad 135. The code "CODE" from the external test device may be transmitted to the peripheral block 130 through the second connection pad 135, and then, may be transmitted from the peripheral block 130 to the fifth multiplexer 122_5.

As described with reference to FIG. 5, after the test operation is completed, the first connection pad 124 or the third connection pad 127 may be used to convey at least one signal of various signals including a clock signal.

Figure 8:
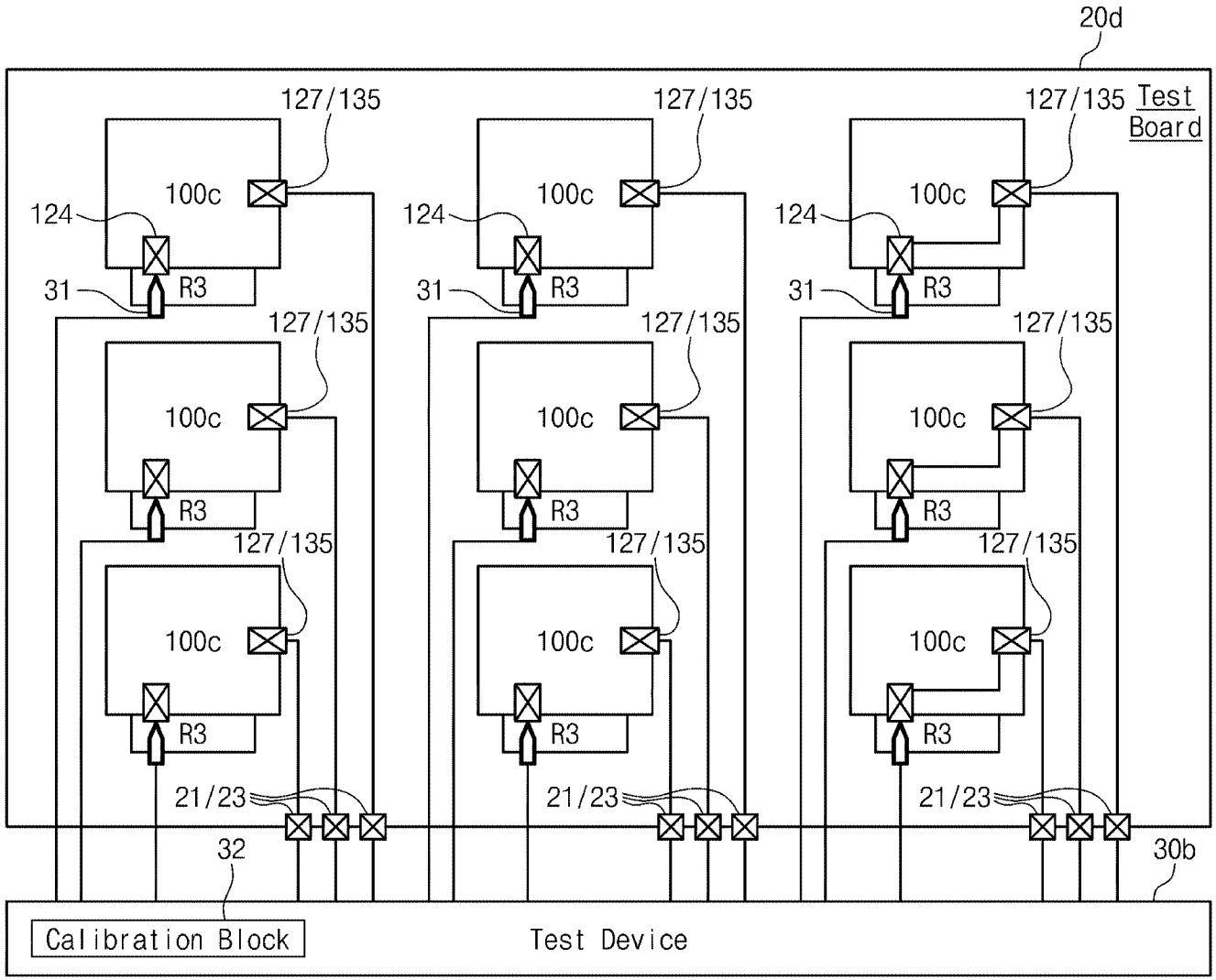
FIG. 8 is a diagram illustrating another example in which integrated circuits are attached to a test board and are tested.

FIG. 8 is a diagram illustrating another example in which integrated circuits 100*c* are attached to a test board 20*d* and are tested. In FIG. 8, to prevent a drawing from being unnecessarily complicated, the second connection pad 135 and the third connection pad 127 are illustrated as an integrated connection pad 127/135, and the first test port 21 and the second test port 23 are also illustrated as an integrated test port 21/23.

Compared to FIG. 6, a test device 30*b* may respectively probe the seventh voltages V7 of the third resistors R3 of the test board 20*d* by using needle tips 31. The test device 30*b* may include a calibration block 32 which calculates calibrated codes from the seventh voltages V7 of the third resistors R3.

The calibration block 32 may include components which are similar to the first current generation unit 12*a*, 12*b*, or 12*c* and the calibration unit 14*a*, 14*b*, or 14*c* described with reference to FIG. 1, 5, or 7 but are more complicated, and a processor which executes commands for performing functions of such components. The test device 30*b* may respectively transmit the calibrated codes calculated by the calibration block 32 to the integrated circuits 100*c* through the integrated test ports 21/23 and the integrated connection pads 127/135.

Figure 9:
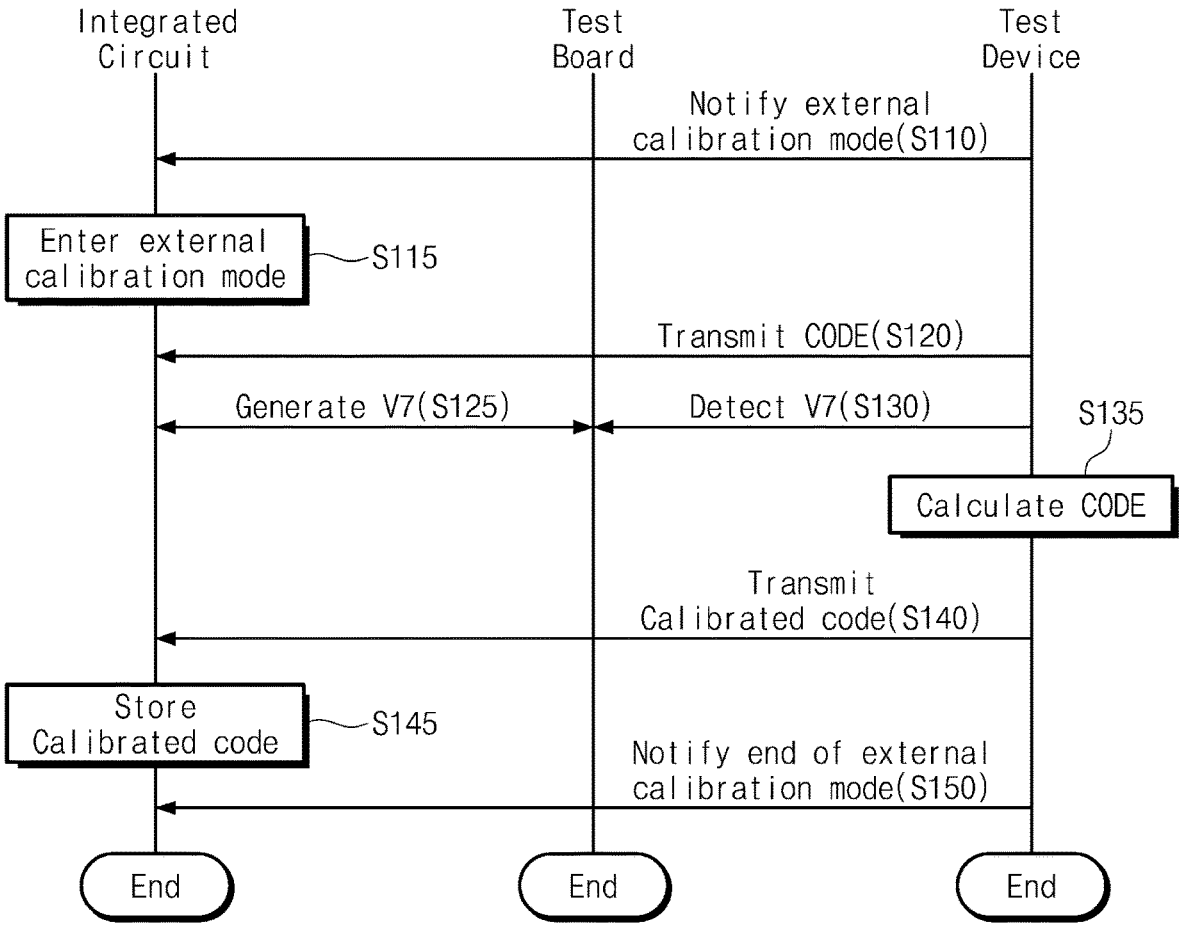
FIG. 9 is a flowchart illustrating an example in which an integrated circuit, a test board, and a test device according to an embodiment of the inventive concept calculate a code.

FIG. 9 is a flowchart illustrating an example in which the integrated circuit 100*c*, the test board 20*d*, and the test device 30*b* according to an embodiment of the inventive concept calculate the code "CODE". In an embodiment, a method of calculating the code "CODE" (e.g., the calibrated code) in the second sub-operating mode of the first operating mode (i.e., the calibration mode) is illustrated in FIG. 8.

Referring to FIGS. 7, 8, and 9, in operation S110, the test device 30*b* may notify the second sub-operating mode, that is, the external calibration mode to the integrated circuit 100*c*. For example, the test device 30*b* may notify the external calibration mode to the bias current generation block 120*c* of the integrated circuit 100*c* through the first test port 21 or the second test port 23.

In operation S115, the bias current generation block 120*c* of the integrated circuit 100*c* may enter the second sub-operating mode, that is, the external calibration mode. In the external calibration mode, the calibration logic 123 may not generate the code "CODE". In operation S120, the test device 30*b* may transmit the code "CODE" to the integrated circuit 100*c*.

In operation S125, the bias current generation block 120*c* of the integrated circuit 100*c* may generate the seventh voltage V7 by flowing the fourth current I4 through the third resistor R3 of the test board 20*d* from the second current generation unit 13*c*. In operation S130, the test device 30*b* may detect the seventh voltage V7 across the third resistor R3 of the test board 20*d*. In an embodiment, operation S120, operation S125, and operation S130 may be performed at the same time. The test device 30*b* may change a value of the code "CODE" and may perform operation S120 to operation S130 two times or more.

In operation S135, the test device 30*b* may calculate the code "CODE" from the seventh voltage V7. For example, the test device 30*b* may perform linear approximation on levels of the seventh voltage V7 and may calculate a calibrated code corresponding to a target level of the seventh voltage V7.

In operation S140, the test device 30*b* may transmit the calibrated code to the bias current generation block 120*c* of the integrated circuit 100*c*. For example, the code "CODE"

may be transmitted to the bias current generation block 120*c* of the integrated circuit 100*c* through the first test port 21 or the second test port 23.

In operation S145, the bias current generation block 120*c* of the integrated circuit 100*c* may store the transmitted calibrated code to the electrical fuse 136. In operation S150, the test device 30*b* may notify an end of the external calibration mode to the bias current generation block 120*c* of the integrated circuit 100*c*.

Afterwards, when the code "CODE" and a resistance value of the first variable resistor VR1 are initialized by a power-off operation or a reset operation, the bias current generation block 120*c* of the integrated circuit 100*c* may calibrate the resistance value of the first variable resistor VR1 depending on the calibrated code stored in the electrical fuse 136.

Figure 10:
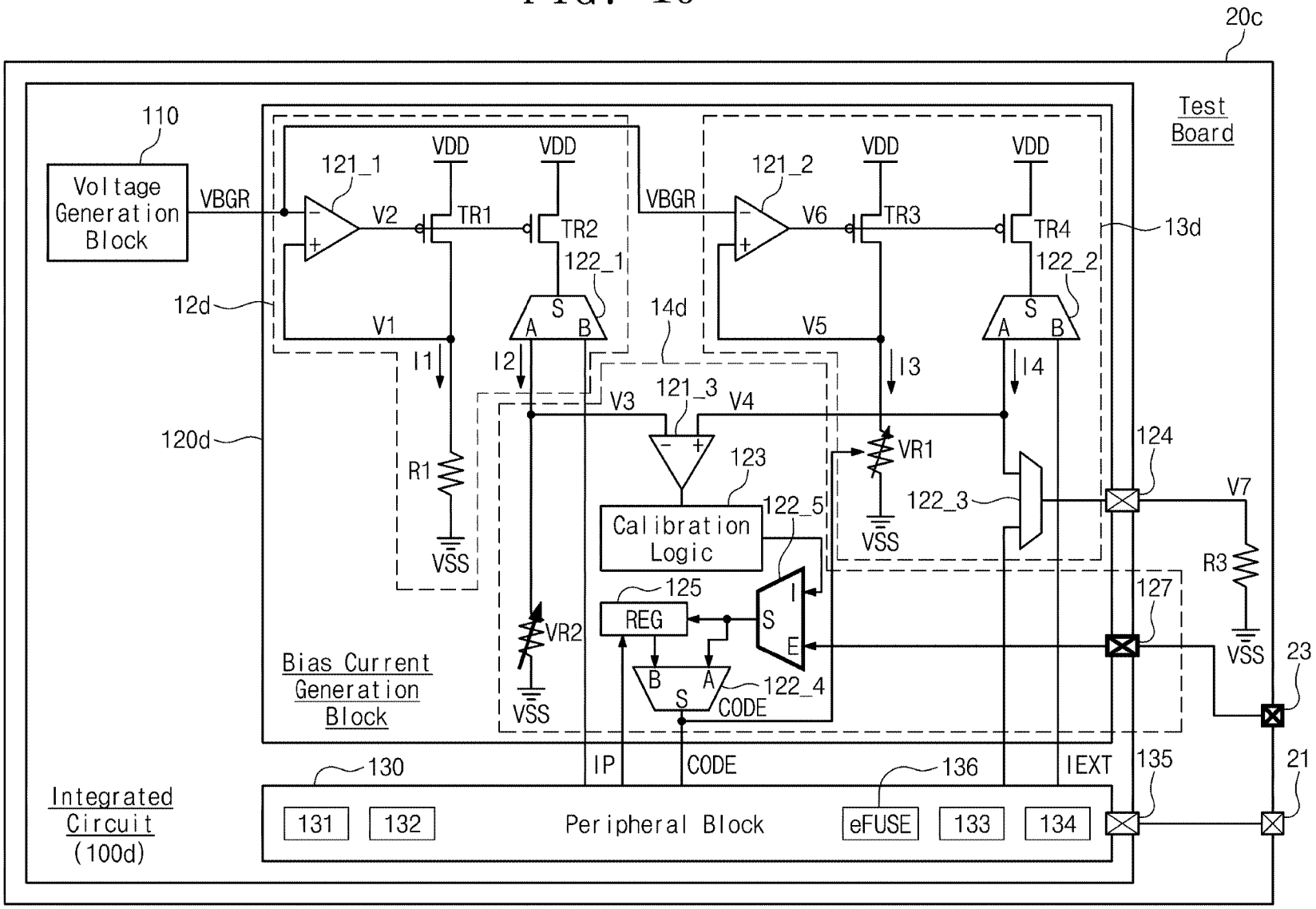
FIG. 10 is a diagram illustrating an integrated circuit and a test board according to a fourth embodiment of the inventive concept.

FIG. 10 is a diagram illustrating an integrated circuit 100*d* and the test board 20*c* according to an exemplary embodiment of the inventive concept. For a brief description, components which are different from the components of the integrated circuit 100*c* of FIG. 7 are marked by a bold line. Referring to FIG. 10, the integrated circuit 100*d* may be positioned on the test board 20*c*. The integrated circuit 100*d* includes the voltage generation block 110, a bias current generation block 120*d*, and the peripheral block 130.

A first current generation unit 12*d* of FIG. 10 may have the same configuration as the first current generation unit 12*c* of FIG. 7 and may operate the same as the first current generation unit 12*c* of FIG. 7. Thus, additional description associated with the first current generation unit 12*d* will be omitted to avoid redundancy. A second current generation unit 13*d* of FIG. 10 may have the same configuration as the second current generation unit 13*c* of FIG. 7 and may operate the same as the second current generation unit 13*c* of FIG. 7. Thus, additional description associated with the second current generation unit 13*d* will be omitted to avoid redundancy.

Compared with the calibration unit 14*c* of FIG. 7, a calibration unit 14*d* of FIG. 10 may include a second variable resistor VR2 instead of the second resistor R2. A resistance value of the second variable resistor VR2 may be adjusted by the calibration logic 123 or by an external test device. In Equation 1, the second resistor R2 may be replaced with the second variable resistor VR2. Accordingly, a level of the third voltage V3 may vary with the resistance value of the second variable resistor VR2.

According to Equation 1 and Equation 2, the calibration unit 14*d* generates the code "CODE" which allows a ratio VR2/R1 of the second variable resistor VR2 to the first resistor R1 to be the same as a ratio R3/VR1 of the third resistor R3 to the first variable resistor VR1. Accordingly, the ratio of the third resistor R3 to the first variable resistor VR1 may be adjusted by adjusting the resistance value of the second variable resistor VR2. For example, the resistance value of the second variable resistor VR2 may vary with process variations or a design target.

In an embodiment, the second resistor R2 of the integrated circuit 100*a* or 100*b* described with reference to FIG. 1 or 5 may also be replaced with the second variable resistor VR2. As described with reference to FIG. 5, after the test operation is completed, the first connection pad 124 or the third connection pad 127 may be used to convey at least one signal of various signals including a clock signal.

Figure 11:
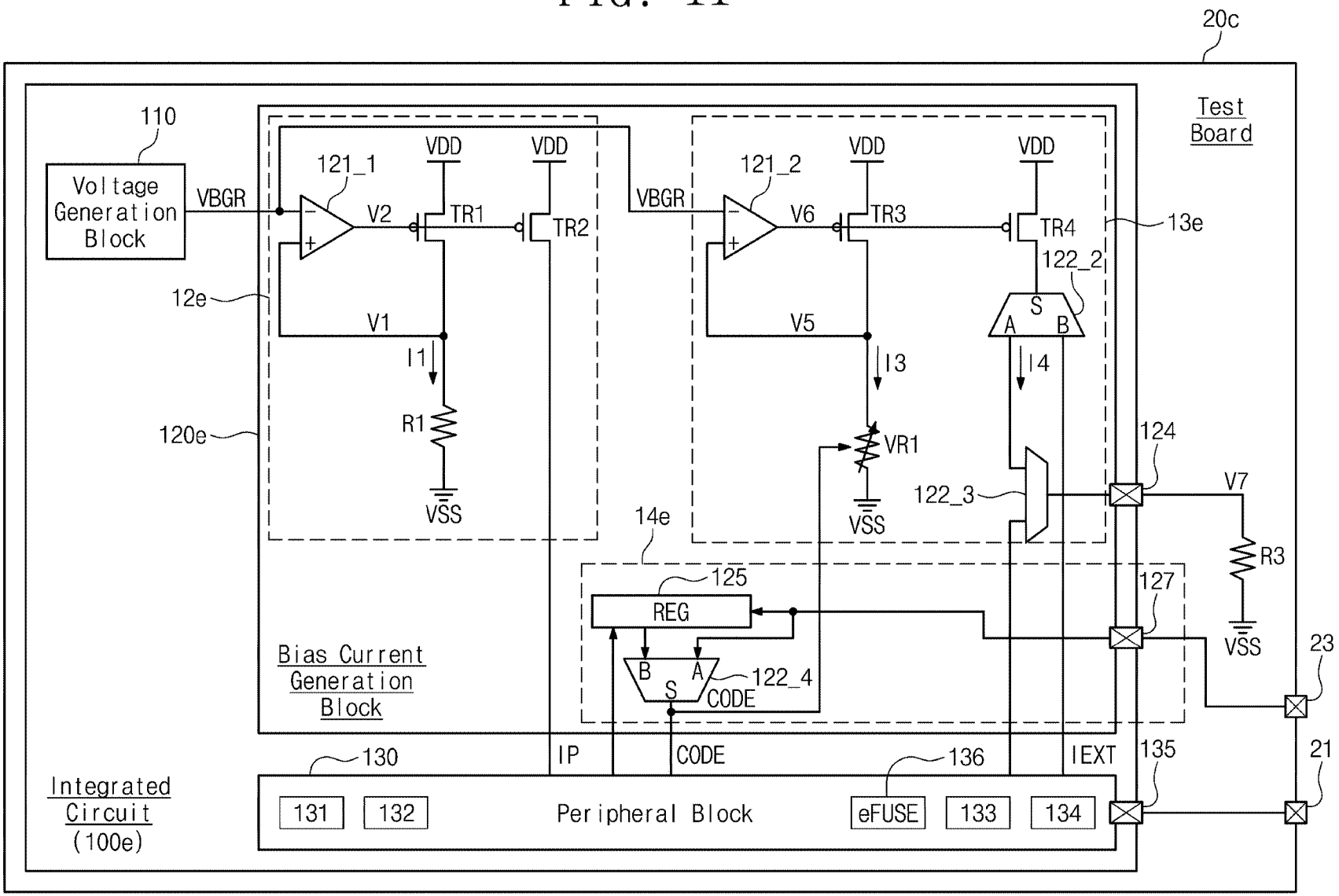
FIG. 11 is a diagram illustrating an integrated circuit and a test board according to a fifth embodiment of the inventive concept.

FIG. 11 is a diagram illustrating an integrated circuit 100*e* and the test board 20*c* according to an exemplary embodiment of the inventive concept. Referring to FIG. 11, the integrated circuit 100*e* may be positioned on the test board 20*c*. The integrated circuit 100*e* includes the voltage generation block 110, a bias current generation block 120*e*, and the peripheral block 130.

A first current generation unit 12*e* of FIG. 11 may have the same configuration as the first current generation unit 12*d* of FIG. 10 and may operate the same as the first current generation unit 12*d* of FIG. 10. Thus, additional description associated with the first current generation unit 12*e* will be omitted to avoid redundancy. A second current generation unit 13*e* of FIG. 11 may have the same configuration as the second current generation unit 13*d* of FIG. 10 and may operate the same as the second current generation unit 13*d* of FIG. 10. Thus, additional description associated with the second current generation unit 13*e* will be omitted to avoid redundancy.

Compared with the calibration unit 14*d* of FIG. 10, a calibration unit 14*e* of FIG. 11 includes the register 125, the fourth multiplexer 122_4, and the third connection pad 127. The register 125 may store the code "CODE" transmitted from an external test device through the second test port 23 and the third connection pad 127.

The fourth multiplexer 122_4 may output one of the code "CODE" stored in the register 125 and the code "CODE" transmitted from the third connection pad 127. The code "CODE" output from the fourth multiplexer 122_4 may be transmitted to the first variable resistor VR1 and may be transmitted to the peripheral block 130.

The code "CODE" (e.g., the calibrated code) may be programmed to the electrical fuse 136. In the second operating mode (i.e., the normal operating mode), the peripheral block 130 may provide the code "CODE" (e.g., the calibrated code) programmed to the electrical fuse 136 to the register 125.

As described with reference to FIG. 5, after the test operation is completed, the first connection pad 124 or the third connection pad 127 may be used to convey at least one signal of various signals including a clock signal.

Figure 12:
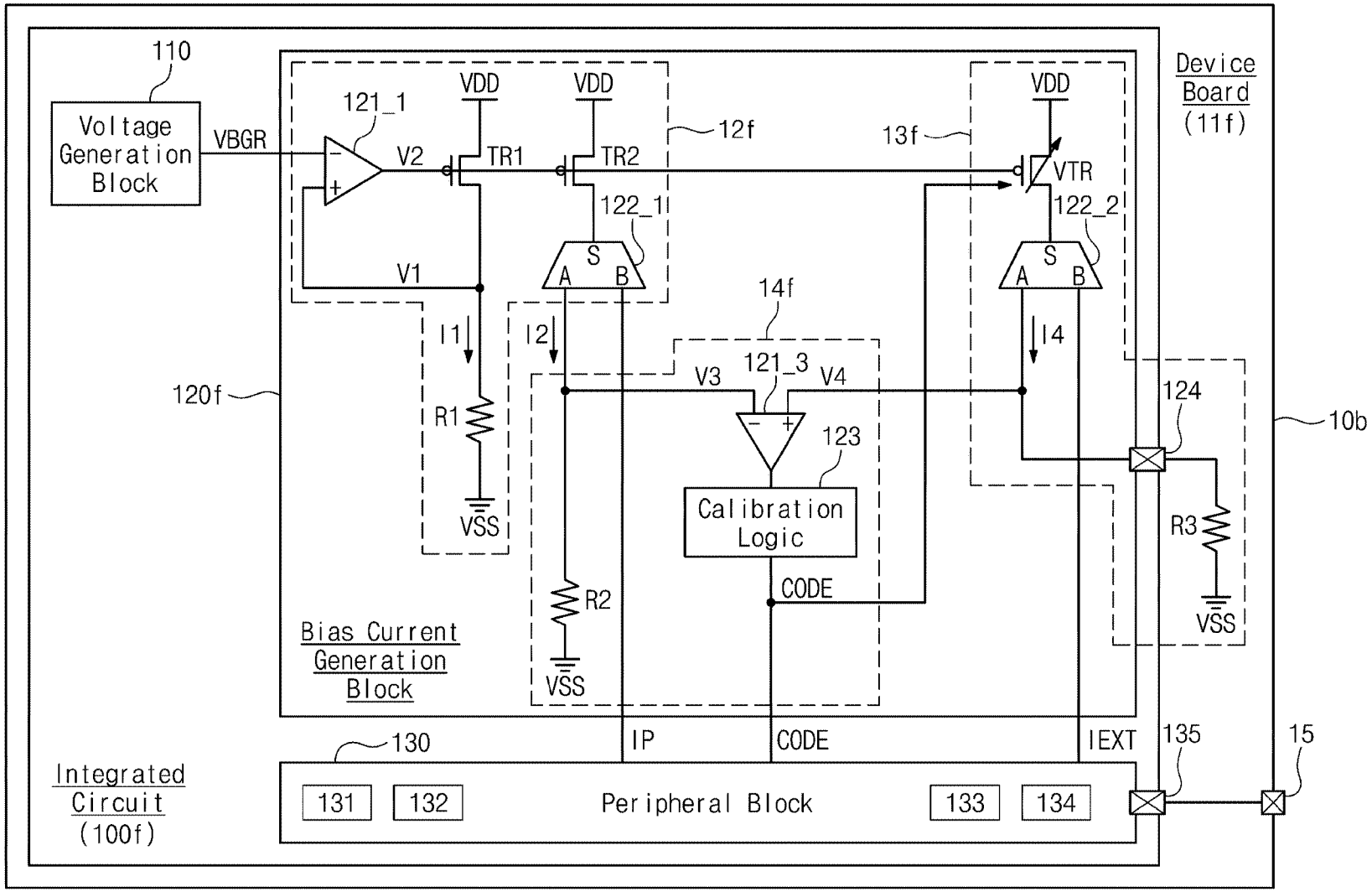
FIG. 12 is a diagram illustrating a semiconductor device including an integrated circuit according to a sixth embodiment of the inventive concept.

FIG. 12 is a diagram illustrating a semiconductor device 10*b* including an integrated circuit 100*f* according to an exemplary embodiment of the inventive concept. Referring to FIG. 12, the integrated circuit 100*f* and the third resistor R3 may be positioned on a device board 11*f*. The integrated circuit 100*f* includes the voltage generation block 110, a bias current generation block 120*f*, and the peripheral block 130.

A first current generation unit 12*f* of FIG. 12 may have the same configuration as the first current generation unit 12*a* of FIG. 1 and may operate the same as the first current generation unit 12*a* of FIG. 1. Thus, additional description associated with the first current generation unit 12*f* will be omitted to avoid redundancy. A calibration unit 14*f* of FIG. 12 may have the same configuration as the calibration unit 14*a* of FIG. 1 and may operate the same as the calibration unit 14*a* of FIG. 1. Thus, additional description associated with the calibration unit 14*f* will be omitted to avoid redundancy.

A second current generation unit 13*f* includes a variable transistor VTR, the second multiplexer 122_2, the first connection pad 124, and the third resistor R3. Compared with the second current generation unit 13*a* of FIG. 1, the second current generation unit 13*f* may include the variable transistor VTR instead of the second amplifier 121_2, the first variable resistor VR1, the third transistor TR3, and the fourth transistor TR4 in FIG. 1.

The variable transistor VTR is connected between the power node and the second multiplexer 122_2. The second voltage V2 may be supplied to a gate of the variable transistor VTR. That is, the variable transistor VTR may mirror and output the first current I1.

The size of a channel (e.g., a width of a gate) of the variable transistor VTR may be adjusted by the code "CODE". That is, when the second voltage V2 is uniform, the amount of a current flowing through the variable transistor VTR may be controlled by the code "CODE". The variable transistor VTR may mirror the first current I1 and may adjust a ratio of the amount of the first current I1 and the amount of the mirrored current depending on the code "CODE".

In the first operating mode (e.g., the calibration mode), the second multiplexer 122_2 may connect the first node "S" with the second node "A". The variable transistor VTR may mirror the first current I1 to output the fourth current I4. The fourth current I4 and the fourth voltage V4 generated by the third resistor R3 may be provided to the calibration unit 14*f*.

The third amplifier 121_3 of the calibration unit 14*f* may compare the third voltage V3 and the fourth voltage V4. As described with reference to FIG. 3, the calibration logic 123 of the calibration unit 14*f* may generate the code "CODE" (e.g., the calibrated code) which allows the fourth voltage V4 to be the same as the third voltage V3. That is, the calibration unit 14*f* may calculate the amount of the fourth current I4 such that the third voltage V3, from which the process variations are removed, and the fourth voltage V4, to which the process variations are applied are the same each other.

When a current amount of the variable transistor VTR is adjusted by the code "CODE", the process variations applied to the first resistor R1 may be calibrated using the variable transistor VTR. Accordingly, the variable transistor VTR may output an absolute current, in which the process variations are not applied (or calibrated), as the second bias current IEXT.

In an embodiment, when two or more second bias currents IEXT are necessary, two or more variable transistors VTR may be provided. The second voltage V2 may be supplied in common to gates of the two or more variable transistors VTR. Current amounts of the two or more variable transistors VTR may be adjusted in common by the code "CODE". The two or more variable transistors VTR may supply the two or more second bias currents IEXT, respectively.

Figure 13:
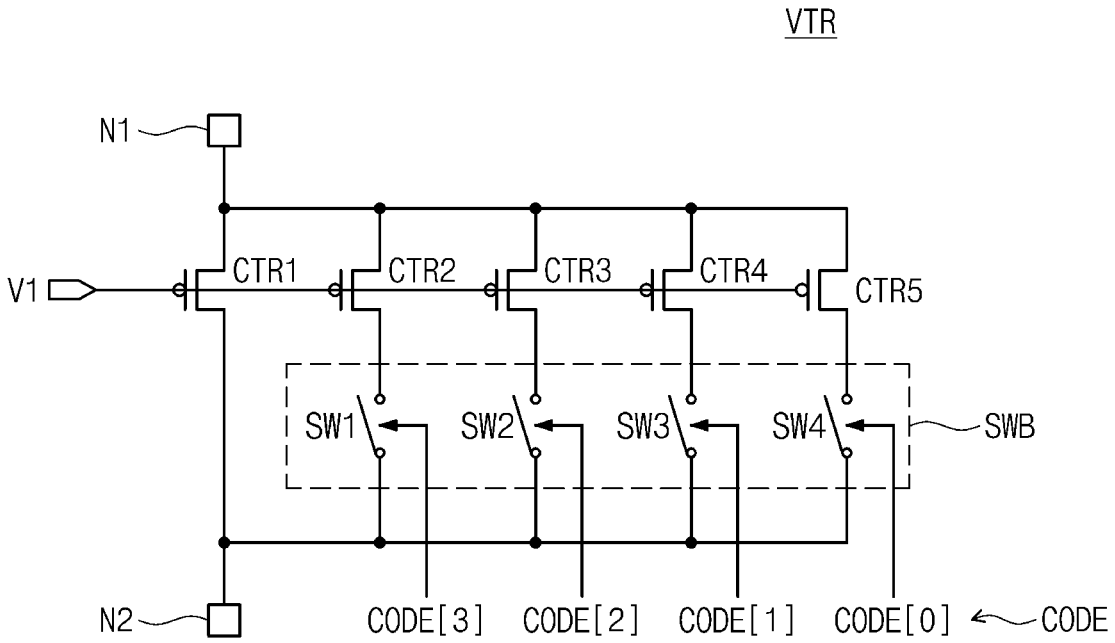
FIG. 13 is a diagram illustrating an example of a variable transistor of a second current generation unit of FIG. 11.

FIG. 13 is a diagram illustrating an example of the variable transistor VTR of the second current generation unit 13*f* of FIG. 12. Referring to FIGS. 12 and 13, the variable transistor VTR may include first to fifth calibration transistors CTR1 to CTR5 and the switch unit SWB. The first calibration transistor CTR1 is connected between the first node N1 and the second node N2. The first node N1 may be connected with the power node. The second node N2 may be connected with the first node "S" of the second multiplexer 122_2.

In operation, the first calibration transistor CTR1 is always connected between the first node N1 and the second node N2 regardless of a value of the code "CODE". The first calibration transistor CTR1 may be referred to as a base calibration transistor. A channel width (e.g., a gate width) (or a current amount) of the first calibration transistor CTR1 may determine an intercept value of a vertical axis in a graph associated with the fourth voltage V4 of FIG. 3.

In operation, the second to fifth calibration transistors CTR2 to CTR5 may be selectively connected between the first node N1 and the second node N2 depending on a value of the code "CODE". Current amounts of the second to fifth calibration transistors CTR2 to CTR5 may determine a slope in the graph associated with the fourth voltage V4 of FIG. 3.

The sizes (e.g., gate widths) of the second to fifth calibration transistors CTR2 to CTR5 may be determined in ratios of 8:4:2:1 depending on binary weights. In the case where the sizes of the second to fifth calibration transistors CTR2 to CTR5 are determined depending on the binary weights, the size of the variable transistor VTR, that is, the current amount may be adjusted in a binary manner.

However, the sizes of the second to fifth calibration transistors CTR2 to CTR5 are not limited as being determined depending on the binary weights. The sizes of the second to fifth calibration transistors CTR2 to CTR5 may be variously determined depending on a manner of adjusting the current amount of the variable transistor VTR. For example, the calibration transistors CTR2 to CTR4 each has a size in a ratio of a binary-weighted value. The present inventive concept is not limited thereto. For example, the code "CODE" may have a thermometer code for which the second to fifth calibration transistors CTR2 or CTR5 may have the ratio of 1:1:1:1.

The second calibration transistor CTR2 may be connected between the first node N1 and the second node N2 together with the first switch SW1 corresponding to the second calibration transistor CTR2 among switches of the switch unit SWB. The first switch SW1 may be controlled by a third bit (e.g., CODE[3]) being a most significant bit of the code "CODE".

The third calibration transistor CTR3 may be connected between the first node N1 and the second node N2 together with the second switch SW2 corresponding to the third calibration transistor CTR3 among the switches of the switch unit SWB. The second switch SW2 may be controlled by a second bit (e.g., CODE[2]) of the code "CODE".

The fourth calibration transistor CTR4 may be connected between the first node N1 and the second node N2 together with the third switch SW3 corresponding to the fourth calibration transistor CTR4 among the switches of the switch unit SWB. The third switch SW3 may be controlled by a first bit (e.g., CODE[1]) of the code "CODE".

The fifth calibration transistor CTR5 may be connected between the first node N1 and the second node N2 together with the fourth switch SW4 corresponding to the fifth calibration transistor CTR5 among the switches of the switch unit SWB. The fourth switch SW4 may be controlled by a 0-th bit (e.g., CODE[0]) being a least significant bit of the code "CODE".

The first to fourth switches SW1 to SW4 of the switch unit SWB may be respectively controlled by the bits CODE[3] to CODE[0] of the code "CODE". The first to fourth switches SW1 to SW4 of the switch unit SWB may be individually turned on or turned off by the code "CODE". When a specific switch is turned on, a calibration transistor associated with the turned-on switch may be connected between the first node N1 and the second node N2. That is, the size or current amount of the variable transistor VTR may increase.

When the specific switch is turned off, the calibration transistor associated with the turned-off switch may not be connected between the first node N1 and the second node N2. That is, the size or current amount of the variable transistor VTR may decrease. In an embodiment, the first to fourth switches SW1 to SW4 may be implemented with transistors.

Figure 14:
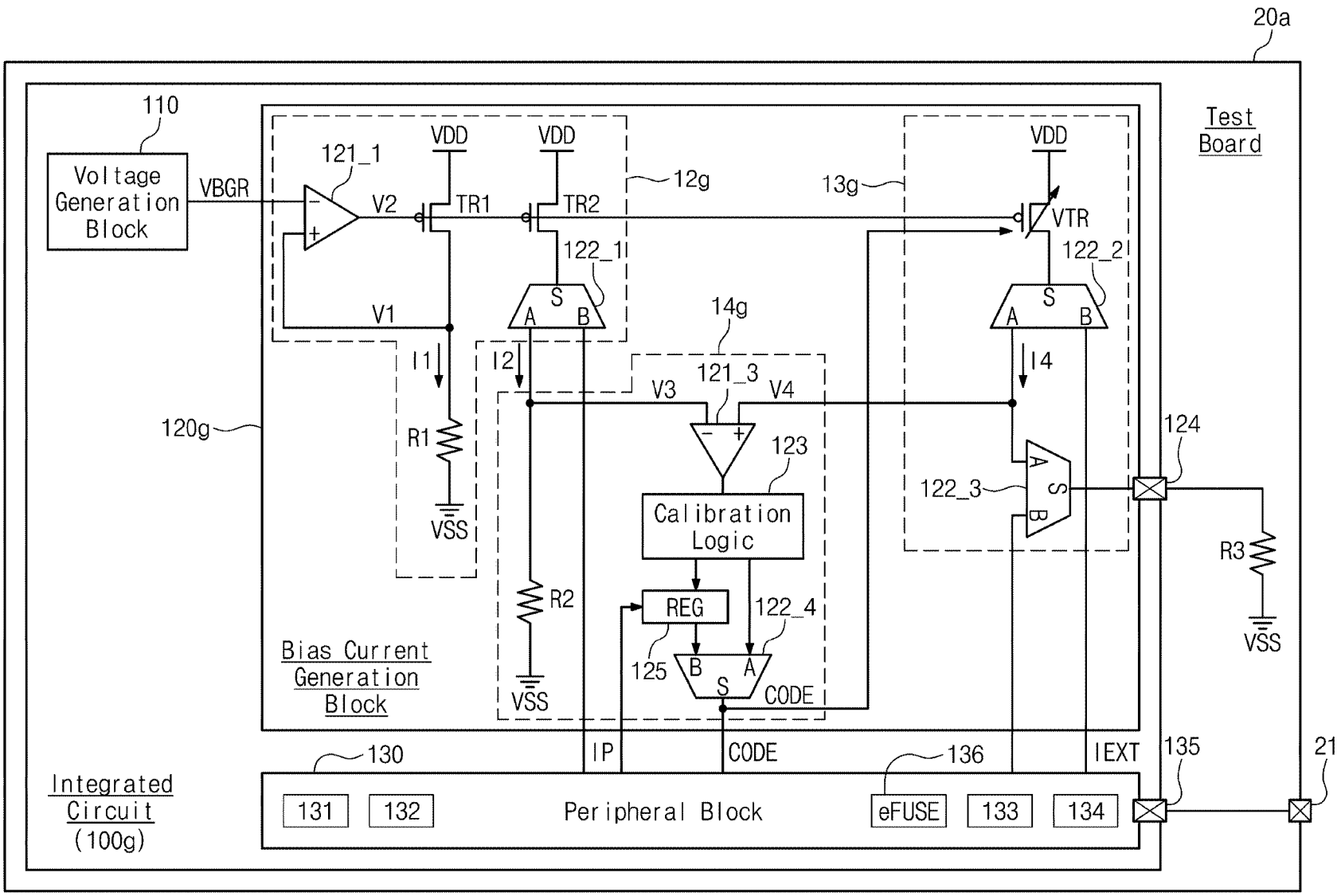
FIG. 14 is a diagram illustrating an integrated circuit and a test board according to a seventh embodiment of the inventive concept.

FIG. 14 is a diagram illustrating an integrated circuit 100*g* and the test board 20*a* according to an exemplary embodiment of the inventive concept. Referring to FIG. 14, the integrated circuit 100*g* and the third resistor R3 may be positioned on the test board 20*a*. The integrated circuit 100*g* may include the voltage generation block 110, a bias current generation block 120*g*, and the peripheral block 130.

A first current generation unit 12*g* of FIG. 14 may have the same configuration as the first current generation unit 12*b* of FIG. 5 and may operate the same as the first current generation unit 12*b* of FIG. 5. Thus, additional description associated with the first current generation unit 12*g* will be omitted to avoid redundancy. A calibration unit 14*g* of FIG. 14 may have the same configuration as the calibration unit 14*b* of FIG. 5 and may operate the same as the calibration unit 14*b* of FIG. 5. Thus, additional description associated with the calibration unit 14*g* will be omitted to avoid redundancy.

As described with reference to FIG. 12, a second current generation unit 13*g* includes the variable transistor VTR, the second multiplexer 122_2, the first connection pad 124, and the third resistor R3. As described with reference to FIG. 12, the calibration unit 14*g* may generate the code "CODE" (e.g., the calibrated code) which allows the fourth voltage V4 to be the same as the third voltage V3. The calibration unit 14*g* may calibrate process variations by adjusting a current amount of the variable transistor VTR depending on the code "CODE".

As described with reference to FIG. 5, the calibrated code may be stored in the register 125. After a test operation is completed, the calibrated code may be programmed to the electrical fuse 136. The test board 20*a* including the third resistor R3 may be separated from the integrated circuit 100*g*. When a power is supplied to the integrated circuit 100*g* in the second operating mode (e.g., the normal operating mode), the peripheral block 130 may provide the calibrated code programmed to the electrical fuse 136 to the register 125. The calibration unit 14*g* may provide the code "CODE" stored in the register 125 to the variable transistor VTR. For example, the integrated circuit 100*g* may be mounted on a device board (for example, 11*a* of FIG. 1) after the test operation is completed. The electrical fuse 136 of the integrated circuit 100*g* may store the calibrated code obtained after the test operation is completed. In this case, the device board need not have an external resistor for the integrated circuit 100*g* to generate a second bias current IEXT. In other words, the integrated circuit 100*g* may generate the second bias current IEXT using the calibrated code of the electrical fuse 136. As described above, the calibrated code may be stored or programmed into the electrical fuse 136 when the integrated circuit 100*g* is fabricated or tested. Accordingly, the external resistor may be omitted from the device board.

In an embodiment, as described with reference to FIG. 6, two or more integrated circuits 100*g* may be coupled to the test board 20*b* and may be tested. As described with reference to FIG. 5, after the test operation is completed, the first connection pad 124 may be used to convey at least one signal of various signals including a clock signal.

Figure 15:
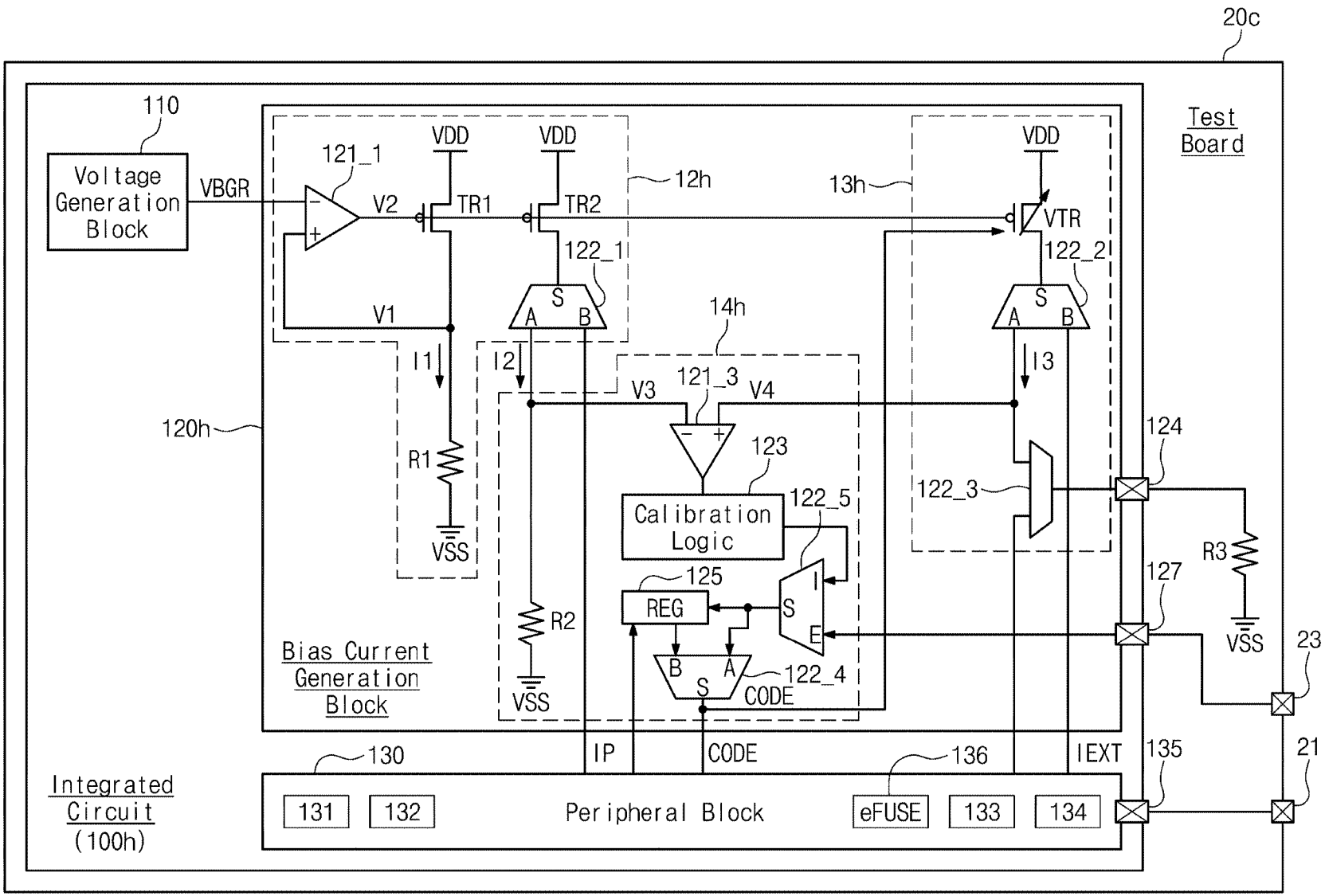
FIG. 15 is a diagram illustrating an integrated circuit and a test board according to an eighth embodiment of the inventive concept.

FIG. 15 is a diagram illustrating an integrated circuit 100*h* and the test board 20*c* according to an exemplary embodiment of the inventive concept. Referring to FIG. 15, the integrated circuit 100*h* and the third resistor R3 may be positioned on the test board 20*c*. The integrated circuit 100*h* includes the voltage generation block 110, a bias current generation block 120*h*, and the peripheral block 130.

A first current generation unit 12*h* of FIG. 15 may have the same configuration as the first current generation unit 12*c* of FIG. 7 and may operate the same as the first current generation unit 12*c* of FIG. 7. Thus, additional description associated with the first current generation unit 12*h* will be omitted to avoid redundancy. A calibration unit 14*h* of FIG. 15 may have the same configuration as the calibration unit 14*c* of FIG. 7 and may operate the same as the calibration unit 14*c* of FIG. 7. Thus, additional description associated with the calibration unit 14*h* will be omitted to avoid redundancy.

As described with reference to FIG. 12, a second current generation unit 13*h* includes the variable transistor VTR, the second multiplexer 122_2, the first connection pad 124, and the third resistor R3. As described with reference to FIG. 10, the first operating mode (i.e., the calibration mode) may include the first sub-operating mode (e.g., the internal calibration mode) and the second sub-operating mode (e.g., the external calibration mode).

In the first sub-operating mode (i.e., the internal calibration mode), as described with reference to FIG. 12, the calibration unit 14*h* may generate the code "CODE" which allows the fourth voltage V4 to be the same as the third voltage V3. The calibration unit 14*h* may calibrate process variations by adjusting a current amount of the variable transistor VTR depending on the code "CODE".

In the second sub-operating mode (i.e., the external calibration mode), as described with reference to FIG. 7, the code "CODE" may be transmitted from an external test device through the test board 20*c*.

After the test operation is completed, the code "CODE" (e.g., the calibrated code) may be programmed to the electrical fuse 136. The test board 20*c* including the third resistor R3 may be separated from the integrated circuit 100*h*. In the second operating mode (i.e., the normal operating mode), the peripheral block 130 may provide the code "CODE" (e.g., the calibrated code) programmed to the electrical fuse 136 to the register 125. The calibration unit 14*h* may provide the code "CODE" stored in the register 125 to the variable transistor VTR.

In an embodiment, as described with reference to FIG. 8, two or more integrated circuits 100*h* may be coupled to the test board 20*d* and may be tested. As described with reference to FIG. 5, after the test operation is completed, the first connection pad 124 or the third connection pad 127 may be used to convey at least one signal of various signals including a clock signal.

Figure 16:
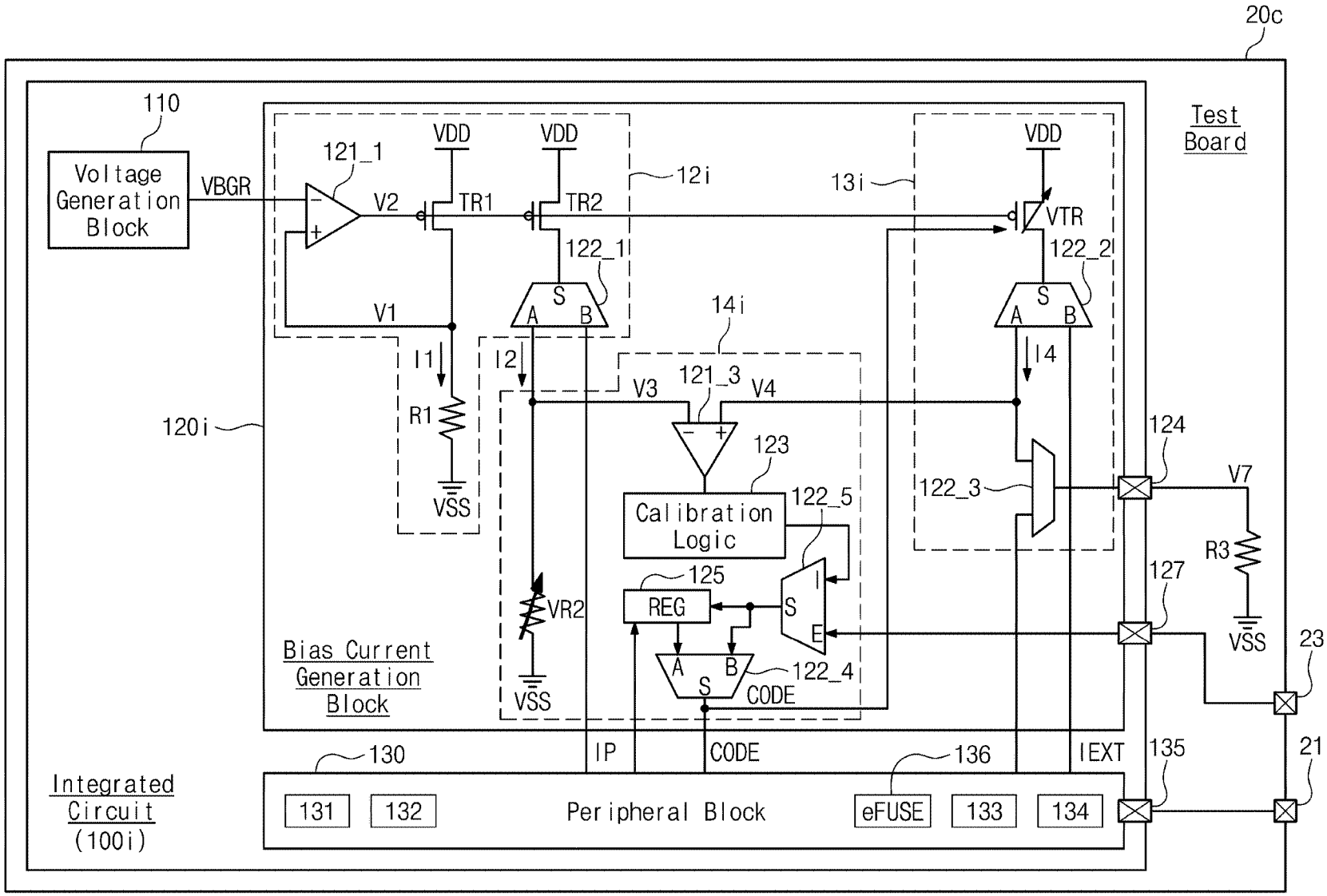
FIG. 16 is a diagram illustrating an integrated circuit and a test board according to a ninth embodiment of the inventive concept.

FIG. 16 is a diagram illustrating an integrated circuit 100*i* and the test board 20*c* according to an exemplary embodiment of the inventive concept. For a brief description, components which are different from the components of the integrated circuit 100*h* of FIG. 15 are marked by a bold line. Referring to FIG. 16, the integrated circuit 100*i* and the third resistor R3 may be positioned on the test board 20*c*. The integrated circuit 100*i* may include the voltage generation block 110, a bias current generation block 120*i*, and the peripheral block 130.

A first current generation unit 12*i* of FIG. 16 may have the same configuration as the first current generation unit 12*h* of FIG. 15 and may operate the same as the first current generation unit 12*h* of FIG. 15. Thus, additional description associated with the first current generation unit 12*i* will be omitted to avoid redundancy. A second current generation unit 13*i* of FIG. 16 may have the same configuration as the second current generation unit 13*h* of FIG. 15 and may operate the same as the second current generation unit 13*h* of FIG. 15. Thus, additional description associated with the second current generation unit 13*i* will be omitted to avoid redundancy.

Compared with the calibration unit 14*h* of FIG. 15, a calibration unit 14*i* of FIG. 16 may include the second variable resistor VR2 instead of the second resistor R2. A resistance value of the second variable resistor VR2 may be adjusted by the calibration logic 123 or by an external test device. As described with reference to FIG. 10, the calibration unit 14*i* may apply process variations to the variable transistor VTR to calibrate a mirroring ratio of the variable transistor VTR.

In addition to the above description, the calibration unit 14*i* may further adjust the mirroring ratio of the variable transistor VTR by adjusting the resistance value of the second variable resistor VR2 such that the ratio VR2/R1 of the second variable resistor VR2 to the first resistor R1 is adjusted.

In an embodiment, the second resistor R2 of the integrated circuit 100*f* or 100*g* described with reference to FIG. 12 or 14 may also be replaced with the second variable resistor VR2. As described with reference to FIG. 5, after the test operation is completed, the first connection pad 124 or the third connection pad 127 may be used to convey at least one signal of various signals including a clock signal.

Figure 17:
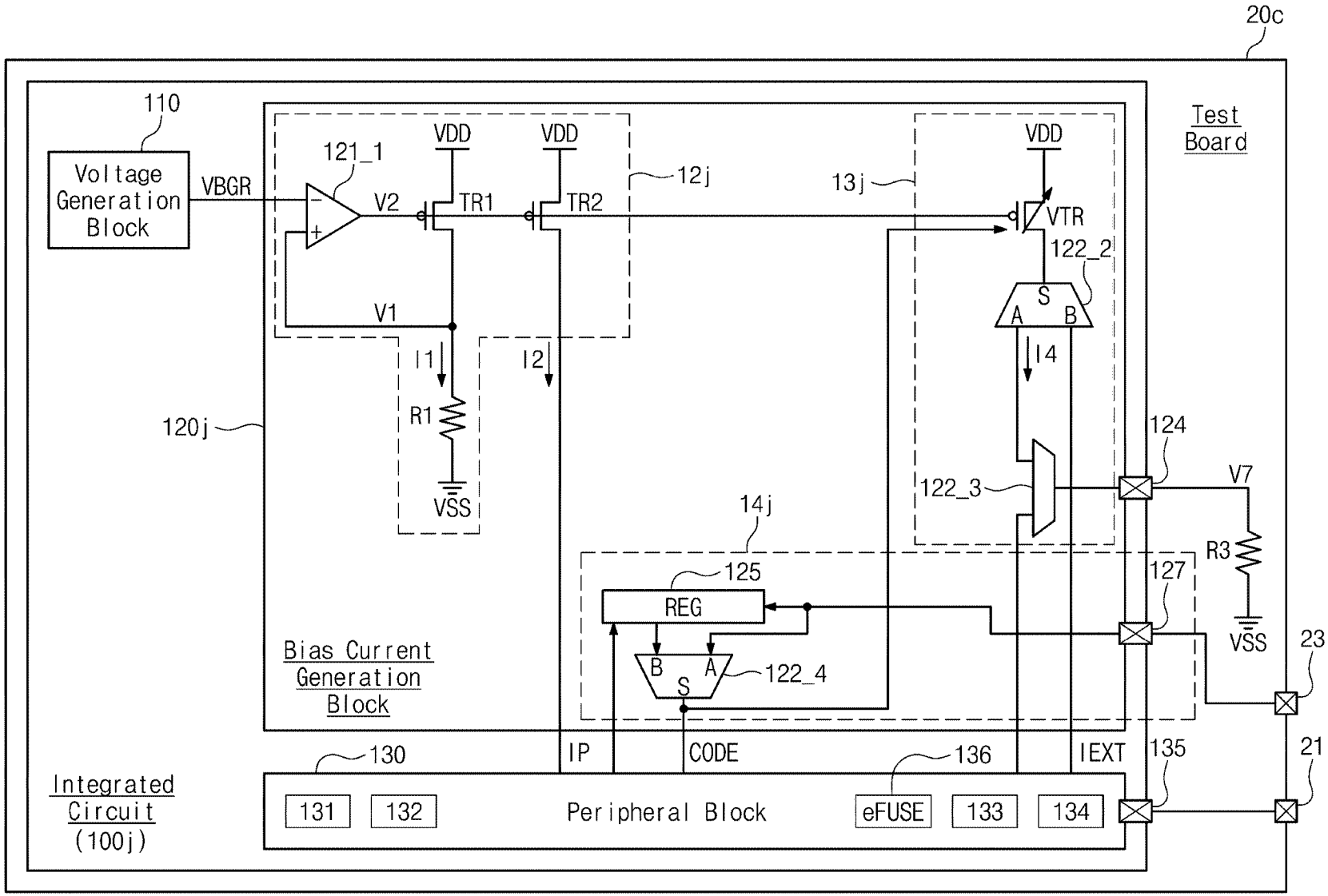
FIG. 17 is a diagram illustrating an integrated circuit and a test board according to a tenth embodiment of the inventive concept.

FIG. 17 is a diagram illustrating an integrated circuit 100*j* and the test board 20*c* according to an exemplary embodiment of the inventive concept. Referring to FIG. 17, the integrated circuit 100*j* and the third resistor R3 may be positioned on the test board 20*c*. The integrated circuit 100*j* may include the voltage generation block 110, a bias current generation block 120*j*, and the peripheral block 130.

A first current generation unit 12*j* of FIG. 17 may have the same configuration as the first current generation unit 12*i* of FIG. 16 and may operate the same as the first current generation unit 12*i* of FIG. 16. Thus, additional description associated with the first current generation unit 12*j* will be omitted to avoid redundancy. A second current generation unit 13*j* of FIG. 17 may have the same configuration as the second current generation unit 13*i* of FIG. 16 and may operate the same as the second current generation unit 13*i* of FIG. 16. Thus, additional description associated with the second current generation unit 13*j* will be omitted to avoid redundancy.

Compared with the calibration unit 14*i* of FIG. 16, a calibration unit 14*j* of FIG. 17 includes the register 125, the fourth multiplexer 122_4, and the third connection pad 127. The register 125 may store the code "CODE" (e.g., the calibrated code) transmitted from an external test device through the second test port 23 and the third connection pad 127.

The fourth multiplexer 122_4 may output one of the code "CODE" stored in the register 125 and the code "CODE" transmitted from the third connection pad 127. The code "CODE" output from the fourth multiplexer 122_4 may be transmitted to the variable transistor VTR and may be transmitted to the peripheral block 130.

The code "CODE" (e.g., the calibrated code) may be programmed to the electrical fuse 136. In the second operating mode (i.e., the normal operating mode), the peripheral block 130 may provide the code "CODE" (e.g., the calibrated code) programmed to the electrical fuse 136 to the register 125.

As described with reference to FIG. 5, after the test operation is completed, the first connection pad 124 or the third connection pad 127 may be used to convey at least one signal of various signals including a clock signal.

Figure 18:
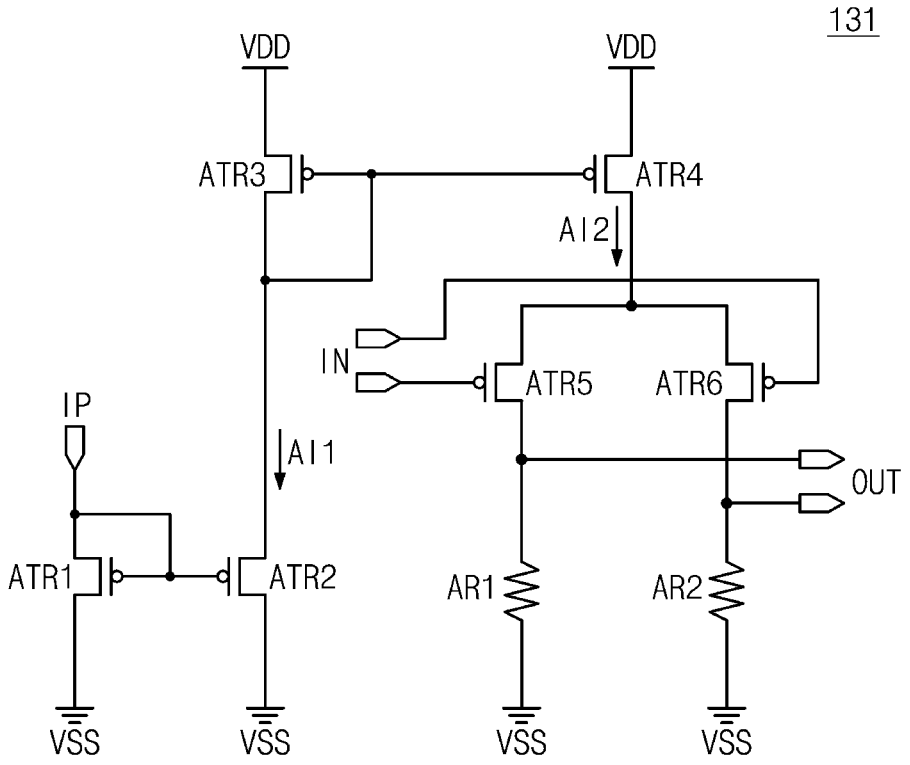
FIG. 18 is a diagram illustrating an example of a first sub-block of a peripheral block described with reference to FIGS. 1 to 17.

FIG. 18 is a diagram illustrating an example of a first sub-block 131 of the peripheral block 130 described with reference to FIGS. 1 to 17. In an embodiment, the first sub-block 131 may include an amplifier including an internal resistor. Referring to FIG. 18, the first sub-block 131 may include first to sixth amplifier transistors ATR1 to ATR6 and first and second amplifier resistors AR1 and AR2.

The first amplifier transistor ATR1 may receive the first bias current IP. The first amplifier transistor ATR1 may mirror the first bias current IP to be transmitted to the second amplifier transistor ATR2. The second amplifier transistor ATR2 may replicate the first bias current IP depending on a ratio of the size of the first amplifier transistor ATR1 and the size of the second amplifier transistor ATR2, and thus, a first amplifier current AI1 may flow through the second amplifier transistor ATR2. The amount of the first amplifier current AI1 may be subject to a process variation.

The third amplifier transistor ATR3 may mirror the first amplifier current AI1 to be transmitted to the fourth amplifier transistor ATR4. The fourth amplifier transistor ATR4 may replicate the first amplifier current AI1 depending on a ratio of the size of the third amplifier transistor ATR3 and the size of the fourth amplifier transistor ATR4, and thus, a second amplifier current AI2 may flow through the fourth amplifier transistor ATR4. The amount of the second amplifier current AI2 may be subject to a process variation.

The fifth amplifier transistor ATR5 and the first amplifier resistor AR1 may be connected in series between the fourth amplifier transistor ATR4 and the ground node. The sixth amplifier transistor ATR6 and the second amplifier resistor AR2 may be connected in series between the fourth amplifier transistor ATR4 and the ground node.

The fourth amplifier transistor ATR4 may supply the second amplifier current AI2 to the fifth and sixth amplifier transistors ATR5 and ATR6. In an embodiment, the second amplifier current AI2 which the fourth amplifier transistor ATR4 supplies is supplied to the first and second amplifier resistors AR1 and AR2 to which process variations are applied. Accordingly, as described with reference to Equation 1, the process variations may be offset in the first sub-block 131.

Figure 19:
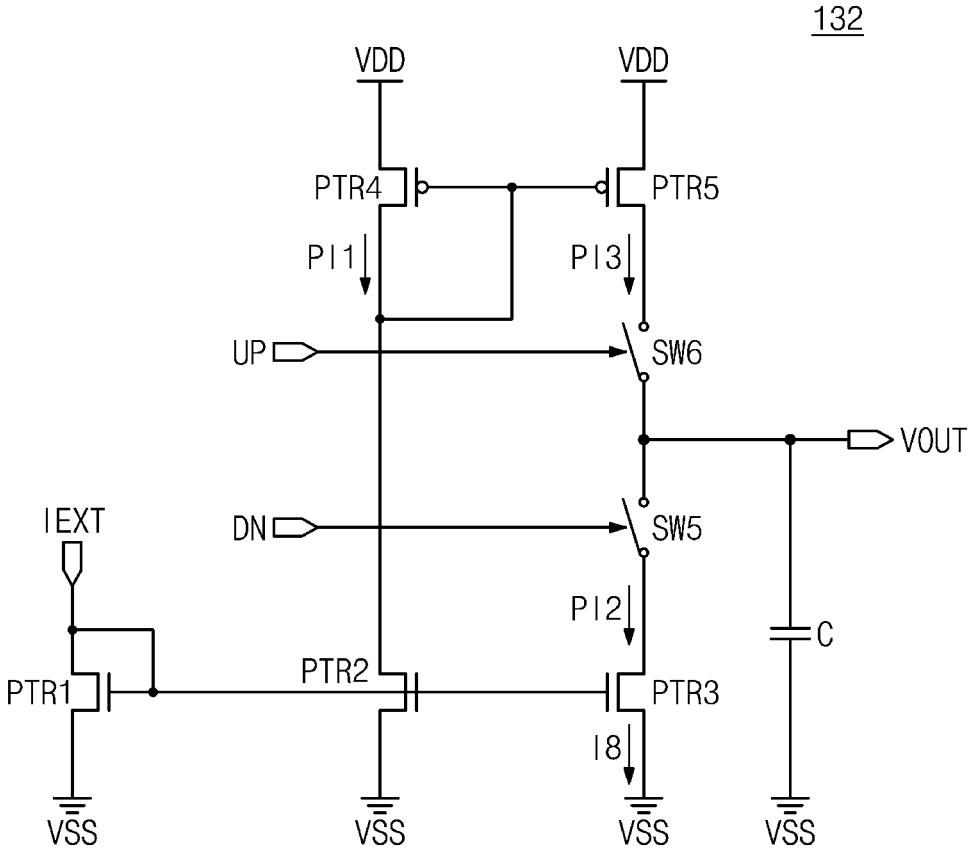
FIG. 19 is a diagram illustrating an example of a second sub-block of a peripheral block described with reference to FIGS. 1 to 17.

FIG. 19 is a diagram illustrating an example of a second sub-block 132 of the peripheral block 130 described with reference to FIGS. 1 to 17. In an embodiment, the second sub-block 132 may include a charge pump. Referring to FIG. 19, the second sub-block 132 may include first to fifth pump transistors PTR1 to PTR5, fifth and sixth switches SW5 and SW6, and a capacitor C.

The first pump transistor PTR1 may receive the second bias current IEXT. The first pump transistor PTR1 may mirror the second bias current IEXT to be transmitted to the second and third pump transistor PTR2 and PTR3.

The second pump transistor PTR2 may replicate the second bias current IEXT depending on a ratio of the size of the first pump transistor PTR1 and the size of the second pump transistor PTR2, and thus, a first pump current PI1 may flow through the second pump transistor PTR2. The amount of the first pump current PH need not be subject to a process variation.

The third pump transistor PTR3 may replicate the second bias current IEXT depending on a ratio of the size of the first pump transistor PTR1 and the size of the third pump transistor PTR3, and thus, a second pump current PI2 may flow through the third pump transistor PTR3. The amount of the second pump current PI2 need not be subject to a process variation.

The fourth pump transistor PTR4 may mirror the first pump current PH to be transmitted to the fifth pump transistor PTR5. The fifth pump transistor PTR5 may replicate the first pump current PI1 depending on a ratio of the size of the fourth pump transistor PTR4 and the size of the fifth pump transistor PTR5, and thus, a third pump current PI3 may flow through the fifth pump transistor PTR5. The amount of the third pump current PI3 need not be subject to a process variation.

In response to a down signal DN, the fifth switch SW5 may supply the second pump current PI2 to the capacitor C or may not supply the second pump current PI2 to the capacitor C. In response to an up signal UP, the sixth switch SW6 may supply the third pump current PI3 to the capacitor C or may not supply the third pump current PI3 to the capacitor C.

The second pump current PI2 and the third pump current PI3 may not pass through a resistor having an influence of a process variation. Accordingly, the process variations may not be applied to components of the second sub-block 132.

Figure 20:
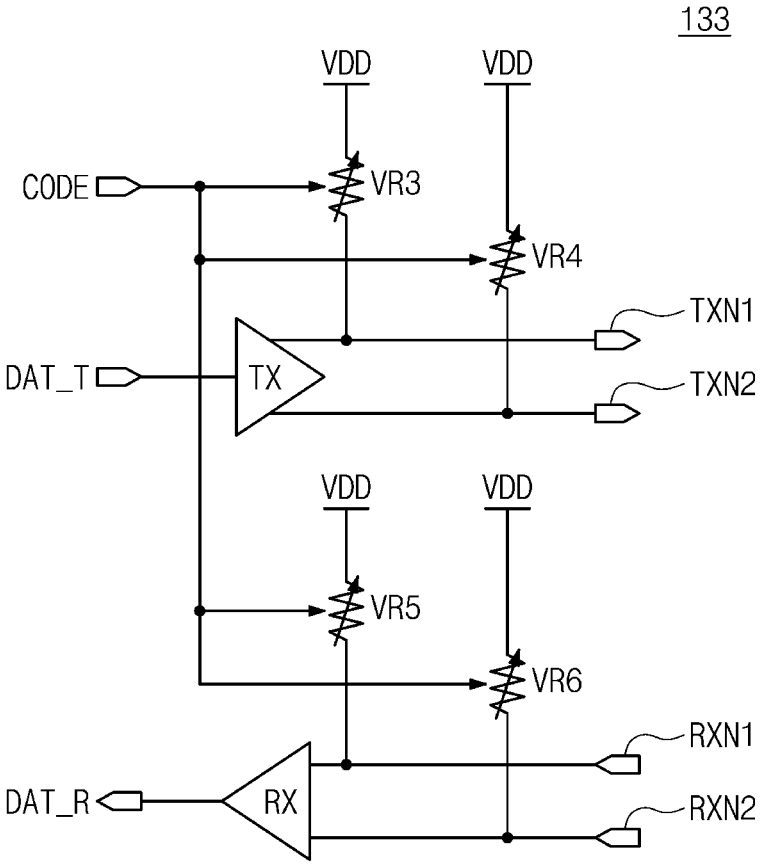
FIG. 20 is a diagram illustrating an example of a third sub-block of a peripheral block described with reference to FIGS. 1 to 17.

FIG. 20 is a diagram illustrating an example of a third sub-block 133 of the peripheral block 130 described with reference to FIGS. 1 to 17. In an embodiment, the third sub-block 133 may include a transmitter TX and a receiver RX.

Referring to FIG. 20, the transmitter TX may transmit outgoing data DAT_T to first and second transmission nodes TXN1 and TXN2. Signals output from the first and second transmission nodes TXN1 and TXN2 may be complementary. For example, the first and second transmission nodes TXN1 and TXN2 may be included in the second connection pad 135.

The receiver RX may receive incoming data DAT_R through first and second reception nodes RXN1 and RXN2. Signals received through the first and second reception nodes RXN1 and RXN2 may be complementary. For example, the first and second reception nodes RXN1 and RXN2 may be included in the second connection pad 135.

As termination resistances, third and fourth variable resistors VR3 and VR4 may be respectively connected to the first and second transmission nodes TXN1 and TXN2. The third and fourth variable resistors VR3 and VR4 may be referred to as on-chip termination resistors formed in the integrated circuit 100*a*, for example. The third variable resistor VR3 may be connected between the power node and the first transmission node TXN1, and the fourth variable resistor VR4 may be connected between the power node and the second transmission node TXN2.

Likewise, as termination resistances, fifth and sixth variable resistors VR5 and VR6 may be respectively connected to the first and second reception nodes RXN1 and RXN2. The fifth and sixth variable resistors VR5 and VR6 may be also referred to as on-chip termination resistors formed in the integrated circuit 100*a* of FIG. 1, for example. The fifth variable resistor VR5 may be connected between the power node and the first reception node RXN1, and the sixth variable resistor VR6 may be connected between the power node and the second reception node RXN2. The first and second reception nodes RXN1 and RXN2 may be included in the second connection pad 135.

The third to sixth variable resistors VR3 to VR6 used as termination resistances should be calibrated to remove process variations. In each of the semiconductor devices 10*a* to 10*j* of the inventive concept, the code "CODE" (e.g., the calibrated code) output from each of the bias current generation blocks 120*a* to 120*j* may be used to calibrate the third to sixth variable resistors VR3 to VR6 without modification.

In an embodiment, as described with reference to FIG. 2, the first variable resistor VR1 may be controlled by the code "CODE" to calibrate process variations. In the case where the third to sixth variable resistors VR3 to VR6 are implemented with the same replica as the first variable resistor VR1, the process variations applied to the third to sixth variable resistors VR3 to VR6 may be removed by the code "CODE" (e.g., the calibrated code).

For example, as described with reference to FIG. 2, the second to fifth calibration resistors CR2 to CR5 in the third to sixth variable resistors VR3 to VR6 may be configured in such a way that resistance values of the second to fifth calibration resistors CR2 to CR5 are increased to double. A resistance value of the first calibration resistor CR1 may be set to be the same as a resistance value of the second calibration resistor CR2.

When a value of the code "CODE" is an intermediate value, each of the third to sixth variable resistors VR3 to VR6 may have the intermediate value. The resistance values of the first to fifth calibration resistors CR1 to CR5 may be set such that the intermediate value of each of the resistance values of the third to sixth variable resistors VR3 to VR6 are target resistance value of each of the third to sixth variable resistors VR3 to VR6.

After the third to sixth variable resistors VR3 to VR6 are fabricated, a resistance value of each of the third to sixth variable resistors VR3 to VR6 may be changed by a process variation. The code "CODE" may be used to remove a process variation from each of the third to sixth variable resistors VR3 to VR6 and to adjust a resistance value of each of the third to sixth variable resistors VR3 to VR6 to a target resistance value.

In an embodiment, as described with reference to FIG. 13, a ratio of the sizes of the calibration transistors CTR1 to CTR5 may be set inversely to a ratio of the resistance values of the first to fifth calibration resistors CR1 to CR5 of FIG. 2. Since a current and a resistance has an inverse relationship, in the case where a ratio of the resistance values of the first to fifth calibration resistors CR1 to CR5 is set inversely to a ratio of the sizes of the calibration transistors CTR1 to CTR5 of the variable transistor VTR, process variations applied to the third to sixth variable resistors VR3 to VR6 may be removed by the calibrated code.

The code "CODE" (e.g., the calibrated code) for adjusting the size (i.e., the current amount) of the variable transistor VTR may be directly used to adjust the resistance values of the third to sixth variable resistors VR3 to VR6, thereby removing the process variations.

Figure 21:
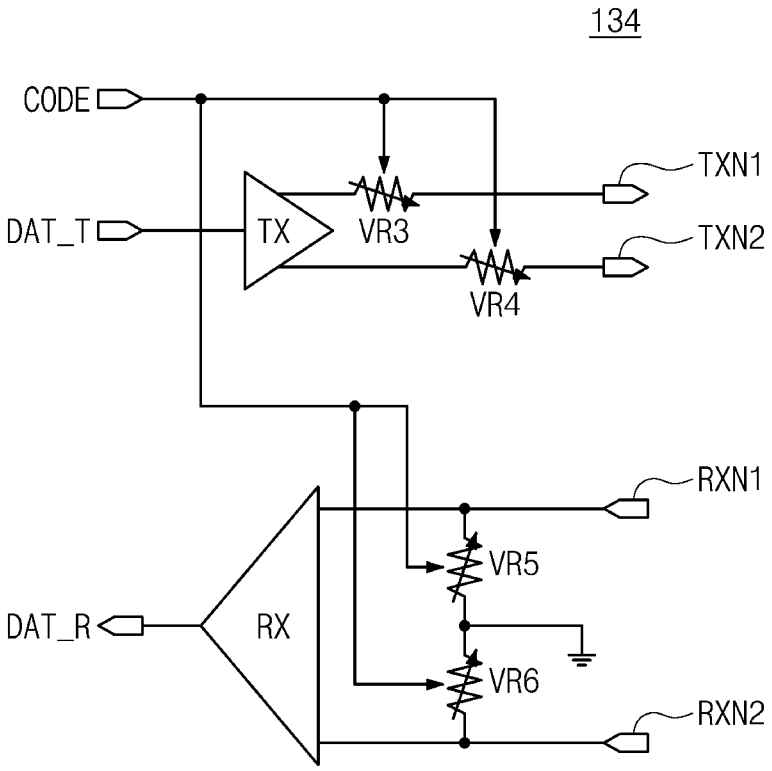
FIG. 21 is a diagram illustrating an example of a fourth sub-block of a peripheral block described with reference to FIGS. 1 to 17.

FIG. 21 is a diagram illustrating an example of a fourth sub-block 134 of the peripheral block 130 described with reference to FIGS. 1 to 17. In an embodiment, the fourth sub-block 134 may include a transmitter TX and a receiver RX.

Referring to FIG. 21, the transmitter TX may transmit the transmission data DAT_T to the first and second transmission nodes TXN1 and TXN2. Signals output from the first and second transmission nodes TXN1 and TXN2 may be complementary. For example, the first and second transmission nodes TXN1 and TXN2 may be included in the second connection pad 135.

As termination resistances, the third variable resistor VR3 and the fourth variable resistor VR4 may be connected between the first transmission node TXN1 and the transmitter TX and between the second transmission node TXN2 and the transmitter TX. The third and fourth variable resistors VR3 and VR4 may be implemented the same as described with reference to FIG. 20 and may be controlled by the code "CODE" in the same manner.

As termination resistances, the fifth and sixth variable resistors VR5 and VR6 may be connected between the first and second reception nodes RXN1 and RXN2. The fifth and sixth variable resistors VR5 and VR6 may be implemented the same as described with reference to FIG. 20 and may be controlled by the code "CODE" in the same manner. The first and second reception nodes RXN1 and RXN2 may be included in the second connection pad 135.

Figure 22:
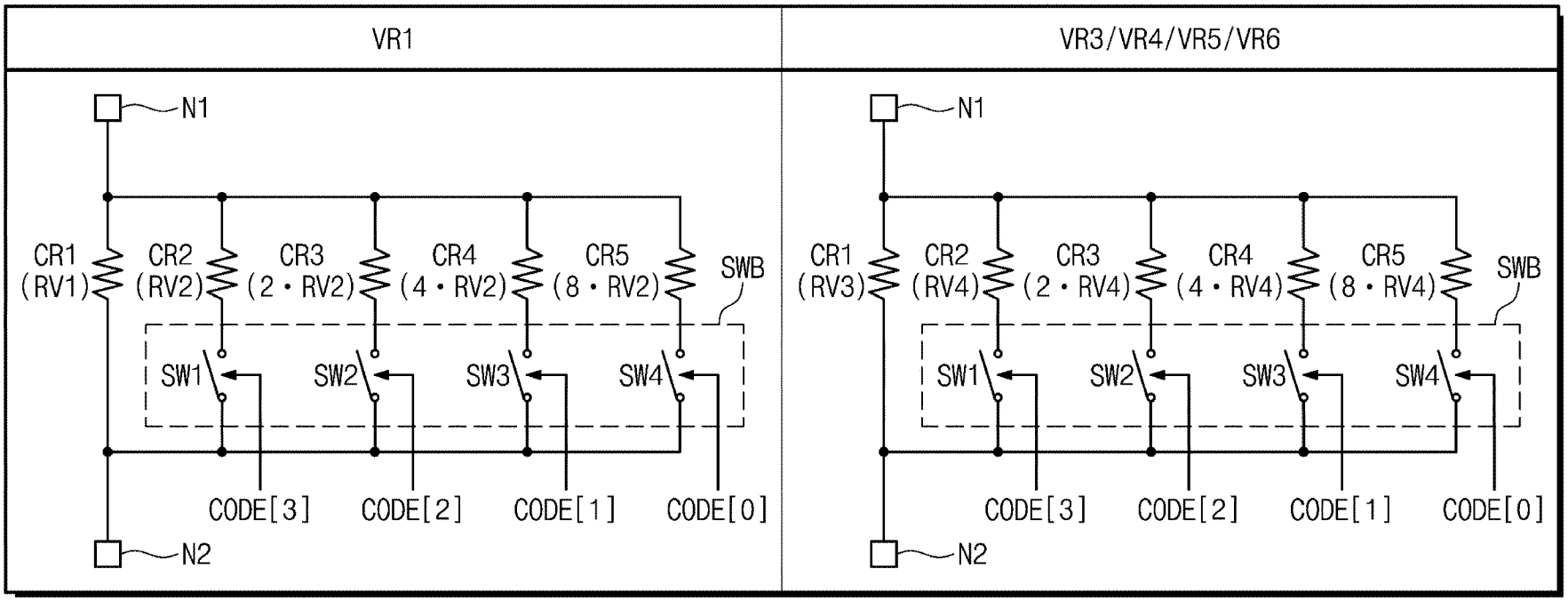
FIG. 22 is a diagram illustrating a first variable resistor described with reference to FIGS. 1 to 11 and third to sixth variable resistors described with reference to FIGS. 20 and 21.

FIG. 22 is a diagram illustrating the first variable resistor VR1 described with reference to FIGS. 1 to 11 and the third to sixth variable resistors VR3 to VR6 described with reference to FIGS. 20 and 21. Referring to FIG. 22, the third to sixth variable resistors VR3 to VR6 used as termination resistances may be implemented with a replica of the first variable resistor VR1 so as to be controlled by the same code "CODE".

The first calibration resistor CR1 of the first variable resistor VR1 may have a first resistance value RV1. The first resistance value RV1 determines an intercept value of a vertical axis of the fourth voltage V4 according to the code "CODE". The first resistance value RV1 of the first variable resistor VR1 may be determined depending on a target resistance value of the first variable resistor VR1.

The first calibration resistor CR1 of each of the third to sixth variable resistors VR3 to VR6 may have a third resistance value RV3. The third resistance values RV3 of each of the third to sixth variable resistors VR3 to VR6 may be determined depending on a target resistance value of each of the third to sixth variable resistors VR3 to VR6. The third resistance values RV3 of the third to sixth variable resistors VR3 to VR6 may be irrelevant to the first resistance value RV1 of the first variable resistor VR1.

The second calibration resistor CR2 of the first variable resistor VR1 may have a second resistance value RV2. The resistance values of the second to fifth calibration resistors CR2 to CR5 may be determined in a ratio of 1:2:4:8 for a binary control. The second resistance value RV2 of the second calibration resistor CR2 may be determined depending on a target resistance value of the first variable resistor VR1.

The second to fifth calibration resistors CR2 to CR5 of the third to sixth variable resistors VR3 to VR6 used as termination resistances may be implemented with a replica of the second to fifth calibration resistor CR2 to CR5 of the first variable resistor VR1 to be controlled by the same code "CODE".

In detail, resistance values of the second to fifth calibration resistors CR2 to CR5 of the third to sixth variable resistors VR3 to VR6 may be determined in a ratio of 1:2:4:8 like the first variable resistor VR1. The fourth resistance values RV4 of the second calibration resistors CR2 in the third to sixth variable resistors VR3 to VR6 may be determined depending on target resistance values of the third to sixth variable resistors VR3 to VR6.

Figure 23:
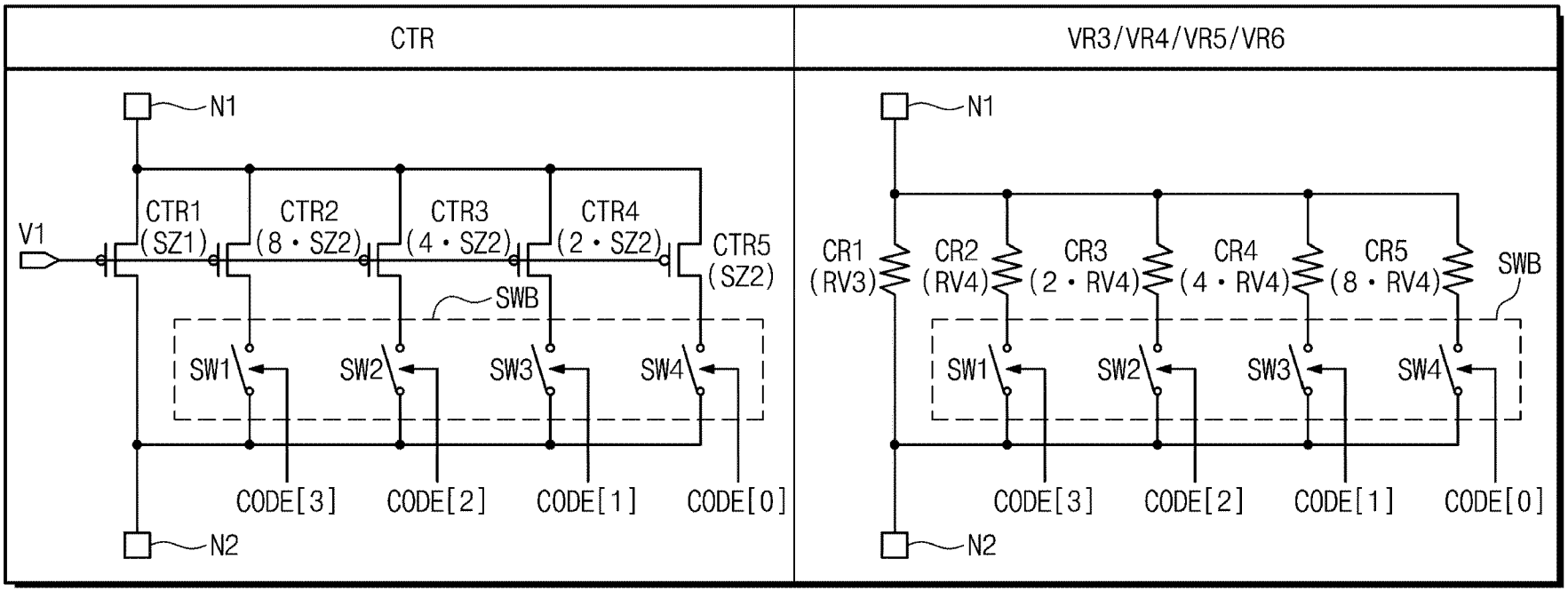
FIG. 23 is a diagram illustrating a variable transistor described with reference to FIGS. 12 to 17 and third to sixth variable resistors described with reference to FIGS. 20 and 21.

FIG. 23 is a diagram illustrating a variable transistor CTR described with reference to FIGS. 12 to 17 and the third to sixth variable resistors VR3 to VR6 described with reference to FIGS. 20 and 21. Referring to FIG. 23, the third to sixth variable resistors VR3 to VR6 used as termination resistances may be implemented with a replica of the variable transistor CTR so as to be controlled by the same code "CODE".

The first calibration transistor CTR1 of the variable transistor CTR may have a first size SZ1. For example, the size of a transistor may indicate a width of a gate of the transistor. The size of the transistor may determine the amount of a current flowing through the transistor when the same voltage is applied to the gate of the transistor.

The first size SZ1 of the first calibration transistor CTR1 of the variable transistor CTR determines an intercept value of a vertical axis of the fourth voltage V4 according to the code "CODE". The first size SZ1 of the first calibration transistor CTR1 of the variable transistor CTR may be determined depending on a target current amount of the variable transistor CTR.

The first calibration resistor CR1 of each of the third to sixth variable resistors VR3 to VR6 may have a third resistance value RV3. The third resistance values RV3 of the third to sixth variable resistors VR3 to VR6 may be determined depending on target resistance values of the third to sixth variable resistors VR3 to VR6. The third resistance values RV3 of the third to sixth variable resistors VR3 to VR6 may be irrelevant to the first size SZ1 of the first calibration transistor CTR1 of the variable transistor CTR.

The fifth calibration transistor CTR5 of the variable transistor CTR may have a second size SZ2. The sizes of the second to fifth calibration transistor CTR2 to CTR5 may be determined in a ratio of 8:4:2:1 for a binary control.

The second to fifth calibration resistors CR2 to CR5 of the third to sixth variable resistors VR3 to VR6 used as termination resistances may be implemented with a replica of the second to fifth calibration transistors CTR2 to CTR5 of the variable transistor CTR to be controlled by the same code "CODE".

Since a resistance value is inversely proportional to a current amount, the second to fifth calibration resistors CR2 to CR5 may be implemented with an inverse replica of the second to fifth calibration transistors CTR2 to CTR5 of the variable transistor CTR.

In detail, resistance values of the second to fifth calibration resistors CR2 to CR5 of the third to sixth variable resistors VR3 to VR6 may be determined inversely to the variable transistor CTR, that is, in a ratio of 1:2:4:8. The fourth resistance values RV4 of the second calibration resistors CR2 in the third to sixth variable resistors VR3 to VR6 may be determined depending on target resistance values of the third to sixth variable resistors VR3 to VR6.

The number of calibration resistors, the number of calibration transistors, the resistance values of the calibration resistors, or the sizes of the calibration transistors may be revised or changed without limitation while the calibration resistors in the variable resistors or the calibration resistors in the variable resistor and the calibration transistors in the variable transistor are maintained with a replica.

In the above-described embodiments, components according to embodiments of the inventive concept are referenced by using the term "block" or "part". The "block" or "part" may be implemented with various hardware devices, such as an integrated circuit (IC), an application specific IC (ASIC), a field programmable gate array (FPGA), and a complex programmable logic device (CPLD), firmware driven in hardware devices, software such as an application, or a combination of a hardware device and software. Also, "block" may include circuits or intellectual property (IP) implemented with semiconductor devices.

Referring back to FIG. 1, a first reference current generator may include a first transistor TR1, a resistor R1 and a first voltage comparator 121_1. A second reference current generator may include a third transistor TR3, a first variable resistor VR1 and a second voltage comparator 121_2. A first bias current generator may include a second transistor TR2. The first bias current generator may further include a second resistor R2 and a first multiplexer 122_1. A second bias current generator includes a fourth transistor TR4. The second bias current generator may further include a second multiplexer and a first connection pad 124. These descriptions may apply to the embodiments of FIGS. 5, 7, 10 and 11.

Referring back to FIG. 12, a first reference current generator may include a first transistor TR1, a resistor R1 and a first voltage comparator 121_1. A first bias current generator may include a second transistor TR2. The first bias current generator may further include a second resistor R2 and a first multiplexer 122_1. A second bias current generator includes a variable transistor VTR. The second bias current generator may further include a second multiplexer and a first connection pad 124. These descriptions may apply to the embodiments of FIGS. 14, 15, 16 and 17.

According to the inventive concept, an integrated circuit of generating a current or a voltage with reduced complexity and reduced fabricating costs and a method of generating a current of the integrated circuit are provided.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. A semiconductor device, comprising:

a voltage generator generating a first reference voltage;

an amplifier receiving the first reference voltage and generating a second reference voltage in response to the first reference voltage;

a first reference current generator receiving the second reference voltage and generating a reference current;

a non-volatile memory storing a calibration code;

a first bias current generator receiving the second reference voltage to mirror the reference current to generate a first bias current in response to the second reference voltage; and a second bias current generator receiving the second reference voltage and generating a second bias current, which is adjusted from the reference current in response to the calibration code of the non-volatile memory and the second reference voltage.

2. The semiconductor device of claim 1, wherein the non-volatile memory includes an electrical fuse, a programmable read-only memory (PROM) or a one-time programmable read-only memory (OTP ROM).

3. The semiconductor device of claim 1, wherein the second bias current generator includes a plurality of calibration transistors arranged in parallel and a plurality of first switches each connected to a corresponding calibration transistor of the plurality of calibration transistors, and wherein the plurality of first switches are controlled by the calibration code such that a current amount of the second bias current is determined according to the calibration code.

4. The semiconductor device of claim 3, further comprising:

an on-chip termination resistor including a plurality of unit termination resistors arranged in parallel and a plurality of second switches each connected to a corresponding unit termination resistor, wherein the plurality of second switches are controlled by the calibration code such that a resistance value of the on-chip termination resistor is determined according to the calibration code, and wherein the plurality of first switches and the plurality of second switches are controlled by the same calibration code.

5. The semiconductor device of claim 4, wherein a number of the plurality of calibration transistors and a number of the plurality of unit termination resistors are the same.

6. The semiconductor device of claim 5, wherein the calibration code is represented by a plurality of binary bits each of which controls a corresponding first switch of the plurality of first switches and a corresponding second switch of the plurality of second switches.

7. The semiconductor device of claim 4, wherein the second bias current generator further includes a base calibration transistor connected in parallel to the plurality of calibration transistors, and wherein the on-chip termination resistor further includes a base termination resistor connected in parallel to the plurality of unit termination resistors.

8. The semiconductor device of claim 4, wherein the plurality of calibration transistors have a size in a ratio of a binary-weighted value or each of the plurality of calibration transistors has the same size.

9. The semiconductor device of claim 8, wherein the plurality of unit termination resistors each has a binary-weighted resistance or has the same resistance.

10. The semiconductor device of claim 3, wherein the first bias current generator includes a transistor, a resistor and a first multiplexer, wherein the first multiplexer includes an output connected to the transistor, a first input connected to the resistor and a second input connected to a peripheral block, and wherein in a calibration mode, the first multiplexer is controlled to connect the first input to the output so that the reference current is mirrored to generate a first voltage across the resistor and in a normal operating mode, the first multiplexer is controlled to connect the second input to the output so that the first bias current is supplied to the peripheral block.

11. The semiconductor device of claim 10, wherein the resistor is a variable resistor.

12. The semiconductor device of claim 10, further comprising:

a first connection pad connected to an external resistor on a test board, wherein the external resistor is, in the calibration mode, connected to the first connection pad and, in the normal operating mode, disconnected to the first connection pad, wherein the second bias current generator further includes a second multiplexer of which an output is connected to the first switches, a first input is connected to the first connection pad and a second input is connected to the peripheral block, and wherein in a calibration mode, the second multiplexer is controlled to connect the first input to the output so that the reference current is mirrored to flow through the first connection pad and the external resistor, thereby generating a second voltage across the external resistor and in a normal operating mode, the second multiplexer is controlled to connect the second input to the output so that the second bias current is supplied to the peripheral block.

13. The semiconductor device of claim 12, wherein in the normal operating mode, each of the first switches is selectively turned on according to the calibration code to supply the second bias current to the peripheral block.

14. The semiconductor device of claim 12, further comprising:

a voltage comparator having a first input connected to a first node between the first multiplexer and the resistor, a second input connected to a second node between the first input of the second multiplexer and the first connection pad and an output generating an output representing a voltage difference between the first node having the first voltage in the calibration mode and the second node having the second voltage in the calibration mode; and a calibration logic receiving the output from the voltage comparator and generating the calibration code based on the voltage difference.

15. The semiconductor device of claim 14, wherein the first node has the second reference voltage.

16. The semiconductor device of claim 14, wherein the second bias current generator further includes a third multiplexer of which a first input is connected to the first input of the second multiplexer, a second input is connected to the peripheral block and an output is connected to the first connection pad, wherein the first input of the third multiplexer is further connected to the second input of the voltage comparator, and wherein in the calibration mode, the third multiplexer connects the first input to the output such that the second node has the second voltage and in the normal operating mode, the third multiplexer connects the second input to the output such that an operating signal for the semiconductor device is transmitted to the peripheral block through the first connection pad.

17. The semiconductor device of claim 16, wherein the operating signal includes a clock signal.

18. The semiconductor device of claim 14, further comprising:

a register connected to the output of the calibration logic; and a fourth multiplexer including a first input connected to the calibration logic, a second input connected to the register and an output connected to the peripheral block and the first switches of the second bias current generator.

19. The semiconductor device of claim 18, wherein the register stores the calibration code generated from the calibration logic in the calibration mode and outputs the calibration code stored through the fourth multiplexer to the first switches of the second bias current generator.

20. The semiconductor device of claim 14, further comprising:

a second connection pad;

a register;

a fourth multiplexer including a first input, a second input connected to the register and an output connected to the peripheral block and the first switches of the second bias current generator; and a fifth multiplexer including a first input connected to the calibration logic, a second input connected to the second connection pad and an output connected to the register and the first input of the fourth multiplexer.

21. The semiconductor device of claim 20, wherein the calibration mode includes an internal calibration mode and an external calibration mode, and wherein the fifth multiplexer, in the internal calibration mode, is connected to the first input to the output such that the calibration code is transmitted from the calibration logic to the first input of the fourth multiplexer and the register and in the external calibration mode, is controlled to connect the second input to the output such that an externally-supplied calibration code is transmitted from the second connection pad to the first input of the fourth multiplexer and the register.

22. The semiconductor device of claim 12, further comprising:

a second connection pad;

a register connected to the second connection pad; and a fourth multiplexer including a first input connected to the second connection pad, a second input connected to the register and an output connected to the peripheral block and the first switches of the second bias current generator.

23. The semiconductor device of claim 22, wherein in the calibration mode, the register receives an externally-supplied calibration code from the second connection pad and the fourth multiplexer is controlled to connect the first input to the output such that after the completion of the calibration mode, the externally-suppled calibration code is programmed as the calibration code of the non-volatile memory thereinto, and wherein in the normal operating mode, the register receives the calibration code programmed in the non-volatile memory and the fourth multiplexer is controlled to connect the second input to the output such that the calibration code is transmitted from the register to the first switches of the second bias current generator.

* * * * *